US007229359B2

(12) United States Patent
Henry et al.

(10) Patent No.: US 7,229,359 B2
(45) Date of Patent: Jun. 12, 2007

(54) CONTINUOUS WATER RIDE

(75) Inventors: Jeffery Wayne Henry, New Braunfels, TX (US); John Schooley, San Francisco, CA (US)

(73) Assignee: Henry, Schooley & Associates, L.L.C., New Braunfels, TX (US)

( * ) Notice: Subject to any disclaimer, the term of this patent is extended or adjusted under 35 U.S.C. 154(b) by 194 days.

(21) Appl. No.: 10/693,654

(22) Filed: Oct. 24, 2003

(65) Prior Publication Data

US 2005/0090318 A1 Apr. 28, 2005

(51) Int. Cl.
*A63G 21/18* (2006.01)

(52) U.S. Cl. ..... 472/117; 472/128

(58) Field of Classification Search ..... 472/116–129; 104/69, 70

See application file for complete search history.

(56) References Cited

U.S. PATENT DOCUMENTS

| | | | |
|---|---|---|---|
| 419,860 | A | 1/1890 | Libbey |
| 435,227 | A | 8/1890 | Inglis |
| 485,624 | A | 11/1892 | Gardner |
| 536,441 | A | 3/1895 | Morris |
| 540,715 | A | 6/1895 | Butler |
| 548,256 | A | 10/1895 | Idler |
| 552,713 | A | 1/1896 | Lenox |
| 555,049 | A | 2/1896 | Ogilbe |
| 566,182 | A | 8/1896 | Jackman |
| 570,016 | A | 10/1896 | Harman |
| 572,426 | A | 12/1896 | Idler |
| 576,704 | A | 2/1897 | Urch |
| 583,121 | A | 5/1897 | Pattee |
| 604,164 | A | 5/1898 | Wilde et al. |
| 640,439 | A | 2/1900 | Boyton |
| 654,980 | A | 6/1900 | Howard |
| 664,179 | A | 12/1900 | Schofield |
| 665,765 | A | 1/1901 | Thompson |
| 689,114 | A | 12/1901 | Pape |

(Continued)

FOREIGN PATENT DOCUMENTS

| | | |
|---|---|---|
| BG | 543055 | 12/1955 |

(Continued)

OTHER PUBLICATIONS

International Search Report for PCT/US01/28542 mailed Mar. 27, 2002.

(Continued)

*Primary Examiner*—Kien Nguyen
(74) *Attorney, Agent, or Firm*—Meyertons, Hood, Kivlin, Kowert & Goetzel, P.C.; Eric B. Meyertons

(57) ABSTRACT

A water transportation system and method are described, generally related to water amusement attractions and rides. Further, the disclosure generally relates to water-powered rides and to a system and method in which participants may be actively involved in a water attraction. This transportation system comprises at least two water stations and at least one water channel connecting the at least two water stations for the purpose of conveying participants between the at least two water stations. In addition, the water transportation system may include conveyor belt systems and water locks configured to convey participants from a first source of water to a second source of water which may or may not be at a different elevation.

26 Claims, 10 Drawing Sheets

U.S. PATENT DOCUMENTS

| | | | |
|---|---|---|---|
| 691,353 | A | 1/1902 | Carpenter et al. |
| 697,202 | A | 4/1902 | Donne |
| 697,891 | A | 4/1902 | Schrader |
| 714,717 | A | 12/1902 | LaPorte |
| 720,014 | A | 2/1903 | Folks |
| 724,040 | A | 3/1903 | Pusterla |
| 724,757 | A | 4/1903 | Symonds |
| 728,303 | A | 5/1903 | Roltair |
| 728,894 | A | 5/1903 | Folks |
| 741,964 | A | 10/1903 | Harlan |
| 743,968 | A | 11/1903 | Wilson |
| 744,880 | A | 11/1903 | Smith |
| 753,311 | A | 3/1904 | Pusterla |
| 753,449 | A | 3/1904 | Thompson |
| 754,698 | A | 3/1904 | Reed |
| 757,286 | A | 4/1904 | Du Clos |
| 760,503 | A | 5/1904 | Welsh |
| 762,566 | A | 6/1904 | Webster et al. |
| 764,675 | A | 7/1904 | Pfeiffer |
| 774,209 | A | 11/1904 | Stubbs |
| 774,274 | A | 11/1904 | Pusterla |
| 774,917 | A | 11/1904 | Maguire |
| 776,936 | A | 12/1904 | Pusterla |
| 779,464 | A | 1/1905 | Bruce |
| 783,425 | A | 2/1905 | Folks |
| 792,422 | A | 6/1905 | Kelly |
| 801,945 | A | 10/1905 | Welsh |
| 808,487 | A | 12/1905 | Stahl |
| 824,436 | A | 6/1906 | Pester |
| 828,689 | A | 8/1906 | Thompson |
| 831,149 | A | 9/1906 | Faller |
| 849,970 | A | 4/1907 | Boyton |
| 868,736 | A | 10/1907 | Washington |
| 869,432 | A | 10/1907 | Gin |
| 879,283 | A | 2/1908 | Mayberry et al. |
| 883,441 | A | 3/1908 | Andrews |
| 891,388 | A | 6/1908 | Visser et al. |
| 896,940 | A | 8/1908 | Rosen |
| 904,848 | A | 11/1908 | DeVore |
| 929,972 | A | 8/1909 | M'Giehan |
| 931,863 | A | 8/1909 | Haight |
| 952,673 | A | 3/1910 | Karr |
| 1,004,174 | A | 9/1911 | Kavakos |
| 1,056,929 | A | 3/1913 | Navarro |
| 1,062,838 | A | 5/1913 | Miller |
| 1,063,949 | A | 6/1913 | Bedient |
| 1,095,965 | A | 5/1914 | Glazier |
| 1,124,950 | A | 1/1915 | Reagen et al. |
| 1,159,519 | A | 11/1915 | Menier |
| 1,167,993 | A | 1/1916 | Guzendorfer |
| 1,195,707 | A | 8/1916 | Miller |
| 1,198,749 | A | 9/1916 | Myers |
| 1,230,559 | A | 6/1917 | Burke |
| 1,249,455 | A | 12/1917 | Myers |
| 1,320,124 | A | 10/1919 | Chrul |
| 1,378,635 | A | 5/1921 | Unger |
| 1,399,469 | A | 12/1921 | Cucullu |
| 1,417,570 | A | 5/1922 | Ridgway |
| 1,440,661 | A | 1/1923 | Dickinson |
| 1,441,126 | A | 1/1923 | Sherman et al. |
| 1,448,306 | A | 3/1923 | Lezert |
| 1,497,754 | A | 6/1924 | Howard |
| 1,520,217 | A | 12/1924 | Auperl |
| 1,540,635 | A | 6/1925 | Kohl |
| 1,551,249 | A | 8/1925 | Held |
| 1,563,855 | A | 12/1925 | Held |
| 1,591,566 | A | 6/1926 | Schmidt et al. |
| 1,601,483 | A | 9/1926 | Vaszin |
| 1,606,024 | A | 11/1926 | Gorhum et al. |
| 1,606,854 | A | 11/1926 | Vaszin |
| 1,607,771 | A | 11/1926 | Miller |
| 1,609,922 | A | 12/1926 | Wiig |
| 1,648,196 | A | 11/1927 | Rohmer |
| 1,763,976 | A | 6/1930 | Lippincott |
| 1,783,268 | A | 12/1930 | Traver |
| 1,849,226 | A | 3/1932 | Erban |
| 1,859,267 | A | 5/1932 | Kurz |
| 1,893,167 | A | 1/1933 | Glagolin |
| 1,926,780 | A | 9/1933 | Lippincott |
| 2,064,035 | A | 12/1936 | Rynearson |
| 2,484,466 | A | 10/1949 | Rumler |
| 2,738,885 | A | 3/1956 | Demaline |
| 2,888,205 | A | 5/1959 | Trucco |
| D190,127 | S | 4/1961 | Fowler |
| 2,991,726 | A | 6/1961 | Miller |
| 3,000,017 | A | 9/1961 | Skovira |
| 3,003,430 | A | 10/1961 | Hamel |
| 3,030,895 | A | 4/1962 | Hamel |
| 3,113,528 | A | 12/1963 | Morgan et al. |
| 3,114,333 | A | 12/1963 | Fowler et al. |
| 3,116,925 | A | 1/1964 | Welch |
| D204,282 | S | 4/1966 | Morgan |
| 3,340,635 | A | 9/1967 | McIntosh |
| 3,390,640 | A | 7/1968 | Couttet et al. |
| 3,404,635 | A | 10/1968 | Bacon et al. |
| 3,456,943 | A | 7/1969 | Brown |
| 3,473,334 | A | 10/1969 | Dexter |
| 3,508,405 | A | 4/1970 | Koch |
| 3,534,413 | A | 10/1970 | Plasseraud |
| 3,598,402 | A | 8/1971 | Frenzl |
| 3,690,265 | A | 9/1972 | Horibata |
| D229,354 | S | 11/1973 | Morgan |
| 3,827,387 | A | 8/1974 | Morgan |
| 3,830,161 | A | 8/1974 | Bacon |
| 3,853,067 | A | 12/1974 | Bacon |
| 3,865,041 | A | 2/1975 | Bacon |
| 3,890,655 | A | 6/1975 | Mathis |
| 3,913,332 | A | 10/1975 | Forsman |
| 3,923,301 | A | 12/1975 | Myers |
| 3,930,450 | A | 1/1976 | Symons |
| 4,001,899 | A | 1/1977 | Mathis |
| 4,063,517 | A | 12/1977 | Nardozzi, Jr. |
| 4,149,469 | A | 4/1979 | Bigler |
| 4,149,710 | A | 4/1979 | Rouchard |
| 4,194,710 | A | 3/1980 | Ebner |
| 4,194,733 | A | 3/1980 | Whitehouse, Jr. |
| 4,196,900 | A | 4/1980 | Becker et al. |
| 4,198,043 | A | 4/1980 | Timbes et al. |
| 4,205,785 | A | 6/1980 | Stanley |
| 4,221,170 | A | 9/1980 | Koudelka |
| 4,225,953 | A | 9/1980 | Simon et al. |
| 4,278,247 | A | 7/1981 | Joppe et al. |
| 4,299,171 | A | 11/1981 | Larson |
| 4,305,117 | A | 12/1981 | Evans |
| 4,337,704 | A | 7/1982 | Becker et al. |
| 4,376,404 | A | 3/1983 | Haddad |
| D269,082 | S | 5/1983 | Spieldiener |
| 4,391,201 | A | 7/1983 | Bailey |
| 4,392,434 | A | 7/1983 | Dürwald |
| 4,429,867 | A | 2/1984 | Barber |
| 4,484,739 | A | 11/1984 | Kreinbihl et al. |
| 4,501,434 | A | 2/1985 | Dupuis |
| 4,516,943 | A | 5/1985 | Spieldiener et al. |
| 4,543,886 | A | 10/1985 | Spieldiener et al. |
| 4,545,574 | A | 10/1985 | Sassak |
| 4,545,583 | A | 10/1985 | Pearman et al. |
| 4,564,190 | A | 1/1986 | Frenzl |
| 4,683,686 | A | 8/1987 | Ozdemir |
| 4,696,251 | A | 9/1987 | Spieldiener et al. |
| 4,778,430 | A | 10/1988 | Goldfarb et al. |
| 4,792,260 | A | 12/1988 | Sauerbier |
| 4,797,027 | A | 1/1989 | Combes et al. |
| 4,805,896 | A | 2/1989 | Moody |
| 4,805,897 | A | 2/1989 | Dubeta |

| | | | | |
|---|---|---|---|---|
| 4,817,312 | A | | 4/1989 | Fuller et al. |
| 4,836,521 | A | | 6/1989 | Barber |
| 4,850,896 | A | | 7/1989 | Smith et al. |
| 4,905,987 | A | | 3/1990 | Frenzi |
| 4,939,358 | A | | 7/1990 | Herman et al. |
| 4,954,014 | A | | 9/1990 | Sauerbier et al. |
| 4,960,275 | A | | 10/1990 | Magon |
| 4,963,057 | A | | 10/1990 | Fournier |
| 4,979,679 | A | | 12/1990 | Downs |
| 4,984,783 | A | | 1/1991 | Fujimaki |
| 5,011,134 | A | | 4/1991 | Langford |
| 5,011,161 | A | | 4/1991 | Galphin |
| 5,020,465 | A | | 6/1991 | Langford |
| 5,022,588 | A | | 6/1991 | Haase |
| 5,033,392 | A | | 7/1991 | Schemitsch |
| 5,069,387 | A | | 12/1991 | Alba |
| 5,069,443 | A | | 12/1991 | Shiratori |
| 5,073,082 | A | | 12/1991 | Radlik |
| 5,137,497 | A | | 8/1992 | Dubeta |
| 5,143,107 | A | | 9/1992 | Kelley |
| 5,152,210 | A | | 10/1992 | Chen |
| 5,167,321 | A | * | 12/1992 | Brodrick, Sr. ..... 198/867.14 |
| 5,171,101 | A | | 12/1992 | Sauerbier et al. |
| 5,183,437 | A | | 2/1993 | Millay et al. |
| 5,194,048 | A | | 3/1993 | Briggs |
| 5,213,547 | A | | 5/1993 | Lochtefeld |
| 5,219,315 | A | | 6/1993 | Fuller et al. |
| 5,224,652 | A | | 7/1993 | Kessler |
| 5,230,662 | A | | 7/1993 | Langford |
| 5,236,280 | A | | 8/1993 | Lochtefeld |
| 5,253,864 | A | | 10/1993 | Heege et al. |
| 5,265,802 | A | | 11/1993 | Hobbs et al. |
| 5,271,692 | A | | 12/1993 | Lochtefeld |
| 5,299,964 | A | | 4/1994 | Hopkins |
| 5,387,158 | A | | 2/1995 | Bertrand |
| 5,393,170 | A | | 2/1995 | Lochtefeld |
| 5,401,117 | A | | 3/1995 | Lochtefeld |
| 5,405,294 | A | | 4/1995 | Briggs |
| 5,421,782 | A | | 6/1995 | Lochtefeld |
| 5,426,899 | A | | 6/1995 | Jones |
| 5,427,574 | A | | 6/1995 | Donnelly-Weide |
| 5,433,671 | A | | 7/1995 | Davis |
| 5,437,463 | A | | 8/1995 | Fromm |
| 5,439,170 | A | | 8/1995 | Dach |
| 5,452,678 | A | | 9/1995 | Simpkins |
| 5,453,054 | A | | 9/1995 | Langford |
| 5,478,281 | A | | 12/1995 | Forton |
| 5,482,510 | A | | 1/1996 | Ishii et al. |
| 5,494,729 | A | | 2/1996 | Henry et al. |
| 5,503,597 | A | | 4/1996 | Lochtefeld et al. |
| 5,536,210 | A | | 7/1996 | Barber |
| 5,540,622 | A | | 7/1996 | Gold et al. |
| 5,564,859 | A | | 10/1996 | Lochtefeld |
| 5,564,984 | A | | 10/1996 | Mirabella et al. |
| 5,613,443 | A | | 3/1997 | Ariga et al. |
| 5,628,584 | A | | 5/1997 | Lochtefeld |
| 5,664,910 | A | | 9/1997 | Lochtefeld et al. |
| 5,667,445 | A | | 9/1997 | Lochtefeld |
| 5,685,778 | A | | 11/1997 | Sheldon et al. |
| 5,704,294 | A | | 1/1998 | Van Winkle et al. |
| 5,716,282 | A | | 2/1998 | Ring et al. |
| 5,732,635 | A | | 3/1998 | McKoy |
| 5,735,748 | A | | 4/1998 | Meyers et al. |
| 5,738,590 | A | | 4/1998 | Lochtefeld |
| 5,766,082 | A | | 6/1998 | Lochtefeld et al. |
| 5,779,553 | A | | 7/1998 | Langford |
| 5,791,254 | A | | 8/1998 | Mares et al. |
| 5,820,471 | A | | 10/1998 | Briggs |
| 5,860,364 | A | | 1/1999 | McKoy |
| 5,950,253 | A | | 9/1999 | Last |
| 5,978,593 | A | | 11/1999 | Sexton |
| 5,989,126 | A | | 11/1999 | Kilbert et al. |
| 6,006,672 | A | | 12/1999 | Newfarmer et al. |
| 6,045,449 | A | | 4/2000 | Aragona et al. |
| 6,075,442 | A | | 6/2000 | Welch |
| 6,146,282 | A | | 11/2000 | McCready et al. |
| 6,161,771 | A | | 12/2000 | Henry |
| 6,186,902 | B1 | | 2/2001 | Briggs |
| 6,210,287 | B1 | | 4/2001 | Briggs |
| 6,237,499 | B1 | | 5/2001 | McKoy |
| 6,261,186 | B1 | | 7/2001 | Henry |
| 6,265,977 | B1 | | 7/2001 | Vega et al. |
| 6,280,342 | B1 | | 8/2001 | Tod |
| 6,336,771 | B1 | | 1/2002 | Hill |
| 6,354,955 | B1 | * | 3/2002 | Stuart et al. ..... 472/117 |
| 6,362,778 | B2 | | 3/2002 | Neher |
| 6,475,095 | B1 | | 11/2002 | Henry |
| 6,533,191 | B1 | | 3/2003 | Berger et al. |
| 6,553,336 | B1 | | 4/2003 | Johnson et al. |
| 6,561,914 | B2 | | 5/2003 | Henry |
| 6,702,687 | B1 | | 3/2004 | Henry |
| 2002/0082097 | A1 | | 6/2002 | Henry et al. |
| 2003/0190967 | A1 | | 10/2003 | Henry |
| 2003/0203760 | A1 | | 10/2003 | Henry et al. |

FOREIGN PATENT DOCUMENTS

| | | |
|---|---|---|
| DE | 129145 | 3/1902 |
| DE | 893778 | 10/1953 |
| WO | 92/03201 | 3/1992 |
| WO | 92/04087 | 3/1992 |
| WO | 97/33668 | 9/1997 |
| WO | WO 98/45006 | 10/1998 |
| WO | 01/10184 | 2/2001 |
| WO | 02/22226 | 3/2002 |
| WO | 02/22227 | 3/2002 |

OTHER PUBLICATIONS

Rorres, C. "The Turn of the Screw: Optimal Design of an Archimedes Screw" *J. of Hydraulic Engineering*, vol. 126, No. 1, pp. 72-80.

Written Opinion regarding European Application No. 01 970 881.7—2307 issued Apr. 13, 2004.

International Search Report regarding PCT Application No. PCT/US01/28542 issued Mar. 27, 2002.

Written Opinion regarding PCT Application No. PCT/US01/28542 issued May 2, 2002.

Written Opinion regarding PCT Application No. PCT/US01/28542 issued Aug. 5, 2002.

International Preliminary Examination Report regarding PCT Application No. PCT/US01/28542 issued Dec. 2, 2002.

Written Opinion regarding European Application No. 01 970 881.7—2307 issued Oct. 10, 2004.

* cited by examiner

CONTINUOUS WATER RIDE

BACKGROUND OF THE INVENTION

1. Field of the Invention

The present disclosure generally relates to water amusement attractions and rides. More particularly, the disclosure generally relates to a system and method for a water transportation system. Further, the disclosure generally relates to water-powered rides and to a system and method in which participants may be actively involved in a water attraction.

2. Description of the Relevant Art

The 80's decade has witnessed phenomenal growth in the participatory family water recreation facility, i.e., the waterpark, and in water oriented ride attractions in the traditional themed amusement parks. The main current genre of water ride attractions, e.g., waterslides, river rapid rides, and log flumes, and others, require participants to walk or be mechanically lifted to a high point, wherein, gravity enables water, rider(s), and riding vehicle (if appropriate) to slide down a chute or incline to a lower elevation splash pool, whereafter the cycle repeats. Some rides can move riders uphill and downhill but for efficiency and performance reasons these rides also generally start on an elevated tower and generally require walking up steps to reach the start of the ride.

Generally speaking, the traditional downhill water rides are short in duration (normally measured in seconds of ride time) and have limited throughput capacity. The combination of these two factors quickly leads to a situation in which patrons of the parks typically have long queue line waits of up to two or three hours for a ride that, although exciting, lasts only a few seconds. Additional problems like hot and sunny weather, wet patrons, and other difficulties combine to create a very poor overall customer feeling of satisfaction or perceived entertainment value in the waterpark experience. Poor entertainment value in waterparks as well as other amusement parks is rated as the biggest problem of the waterpark industry and is substantially contributing to the failure of many waterparks and threatens the entire industry.

Additionally, none of the typical downhill waterpark rides is specifically designed to transport guests between rides. In large amusement parks transportation between rides or areas of the park may be provided by a train or monorail system, or guests are left to walk from ride to ride or area to area. These forms of transportation have relatively minor entertainment value and are passive in nature in that they have little if any active guest-controlled functions such as choice of pathway, speed of riders or rider activity besides sightseeing from the vehicle. They are also generally unsuitable for waterparks because of their high installation and operating costs and have poor ambience within the parks. These types of transportation are also unsuitable for waterpark guests who, because of the large amount of time spent in the water, are often wet and want to be more active because of the combination of high ambient temperatures in summertime parks and the normal heat loss due to water immersion and evaporative cooling. Water helps cool guests and encourages a higher level of physical activity. Guests also want to stay in the water for fun. Waterparks are designed around the original experience of a swimming hole combined with the new sport of river rafting or tubing. The preferred feeling is one of natural ambience and organic experience. A good river ride combines calm areas and excitement areas like rapids, whirlpools, and beaches. Mechanical transportation systems do not fit in well with these types of rides. There exists a need in waterparks for a means of transportation through the park and between the rides.

For water rides that involve the use of a floatation device (e.g., an inner tube or floating board) the walk back to the start of a ride may be particularly arduous since the rider must usually carry the floatation device from the exit of the ride back to the start of the ride. Floatation devices could be transported from the exit to the entrance of the ride using mechanical transportation devices, but these devices are expensive to purchase and operate. Both of these processes reduce guest enjoyment, cause excess wear and tear on the floatation devices, contributes to guest injuries, and makes it impossible for some guests to access the rides. Also, a park that includes many different non-integrated rides may require guests to use different floatation devices for different rides, which makes it difficult for the park operators to provide the guests with a general purpose floatation device. It is advantageous to standardize riding vehicles for rides as much as possible.

Almost all water park rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

Typically waterparks are quite large in area. Typically guests must enter at one area and pass through a changing room area upon entering the park. Rides and picnic areas located in areas distant to the entry area are often underused in relation to rides and areas located near the entry area. More popular rides are overly filled with guests waiting in queue lines for entry onto them. This leads to conditions of overcrowding in areas of the park which leads to guest dissatisfaction and general reduction of optimal guest dispersal throughout the park. The lack of an efficient transportation system between rides accentuates this problem in waterparks.

Water parks also suffer intermittent closures due to inclement weather. Depending on the geographic location of a water park, the water park may be open less than half of the year. Water parks may be closed due to uncomfortably low temperatures associated with winter. Water parks may be closed due to inclement weather such as rain, wind storms, and/or any other type of weather conditions which might limit participant enjoyment and/or participant safety. Severely limiting the number of days a water park may be open naturally limits the profitability of that water park.

SUMMARY

For the reasons stated above and more, it is desirable to create a natural and exciting water transportation system to transport participants between rides as well as between parks that will interconnect many of the presently diverse and stand-alone water park rides. This system would greatly reduce or eliminate the disadvantages stated above. It would relieve the riders from the burden of carrying their floatation devices up to the start of a water ride. It would also allow the riders to stay in the water, thus keeping the riders cool while they are transported to the start of the ride. It would also be used to transport guests from one end of a waterpark to the other, or between rides and past rides and areas of high guest density, or between waterparks, or between guest facilities such as hotels, restaurants, and shopping centers. The transportation system would itself be a main attraction with exciting water and situational effects while seamlessly incorporating into itself other specialized or traditional water rides and events. The system, though referred to herein as a transportation system, would be an entertaining and enjoyable part of the waterpark experience.

In some embodiments, a water transportation system is provided for solving many of the problems associated with waterparks as well as amusement parks in general. The system includes and uses elements of existing water ride technology as well as new elements that provide solutions to the problems that have prevented the implementation of this kind of system in the past. This water-based ride/transportation system combines the concepts of a ride providing transportation, sport, and entertainment. Unlike presently existing amusement park internal transportation rides like trains and monorails, the invention connects the various water amusement rides to form an integrated water park ride/transportation system that will allow guests to spend a far greater amount of their time at the park in the water (or on a floatation device in the water) than is presently possible. It will also allow guests to choose their destinations and ride experiences and allows and encourages more guest activity during the ride.

In certain embodiments, a waterpark may include a continuous water ride. Continuous water rides may include a system of individual water rides connected together. The system may include two or more water rides connected together. Water rides may include downhill water slides, uphill water slides, single tube slides, multiple participant tube slides, space bowls, sidewinders, interactive water slides, water rides with falling water, themed water slides, dark water rides, and accelerator sections in water slides. Connecting water rides may reduce long queue lines normally associated with individual water rides. Connecting water rides may allow participants to remain in the water and/or a vehicle (e.g., a floatation device) during transportation from a first portion of the continuous water ride to a second portion of the continuous water ride.

In some embodiments, a continuous water ride may include an elevation system to transport a participant and/or vehicle from a first elevation to a second elevation. The first elevation may be at a different elevational level than a second elevation. The first elevation may include an exit point of a first water amusement ride. The second elevation may include an entry point of a second water amusement ride. In some embodiments, a first and second elevation may include an exit and entry points of a single water amusement ride. Elevation systems may include any number of water and non-water based systems capable of safely increasing the elevation of a participant and/or vehicle. Elevation systems may include, but are not limited to, spiral transports, water wheels, ferris locks, conveyor belt systems, water lock systems, uphill water slides, and/or tube transports.

Much of the increased time in the water is due to the elimination of the necessity for guests to spend a large amount of time standing in queue lines waiting for rides, as the continuous water ride would be coupled with the ride so that the guest may transfer directly from the system to the ride without leaving the water. The continuous water ride allows guests to easily access remote areas of the park normally underutilized, which will act to increase park capacity; it will allow guests to self-regulate guest densities at various facilities within the system by making it easier and more enjoyable to bypass a high density area and travel to a low density area. Continuous water rides may allow disabled or physically disadvantaged guests to enjoy multiple and extended rides with one floatation device and one entry to and exit from the system. It greatly reduces the amount of required walking by wet guests and reduces the likelihood of slip-and-fall type injuries caused by running guests. It reduces reliance on multiple floatation devices for separate rides and reduces wear and tear on the floatation devices by reducing or eliminating the need to drag them to and from individual rides, and allows park operators to provide guests with a single floatation device for use throughout the park.

In some embodiments, a continuous water ride may function to transport participants and/or vehicles, while reducing or eliminating waiting time in queue lines. Vehicles may include inflated vehicles. Inflated vehicles may be substantially flexible. A non-limiting example of an inflated flexible vehicle may include any type of inflated inner tube. Inflated vehicles may be inflated with any type of gas. Typically inflated vehicles may be inflated with air to lower costs. Vehicles may function to assist in providing buoyancy to a participant during use. Vehicles may carry more than one participant at a time.

One of the first and foremost concerns in a water amusement park is safety. One way to increase safety is by keeping track of participants as they travel through a water amusement park. It may be especially important to ensure a participant has not fallen out and/or been separated from their vehicle. Historically, tracking participants and ensuring they remain with their vehicles has been accomplished manually using human observers. However, human observers are prone to error and/or distraction. Especially within the water amusement park business where typical employees consist of young and/or inexperienced students. It may be difficult to position employees along certain inaccessible portions of a water park.

What is needed is an automated system for observing and monitoring participants in a water amusement park system. An automated system capable of determining if a participant has been separated from their vehicle is described herein. In some embodiments, one such system may include participant identifiers. Participant identifiers may include bands. The bands may be removably coupled to a participant. Participant identifiers may be wirelessly connected to a portion of the water amusement park system. Sensors positioned along portions of the water amusement park system may be used to monitor the participant identifiers. Sensors may be able to collect data based on interaction with participant identifiers within a prescribed area. Data collected by the sensors may be transferred to system controller or system processor. Collected data may be used to assess when one or more participants have been separated from their vehicle(s). In one non-limiting example, pariticipant identifiers may be based on radio frequency. In one non-limiting example, pariticipant identifiers may be based on satellites and global positioning technology (i.e., GPS).

Depending on a water amusement parks geographic location, the waterpark may only be open for less than half of the year due to inclement weather (e.g., cold weather, rain, etc.). What is needed is a way to enclose portions or substantially all of the waterpark when weather threatens to shut down the park. However, it would be beneficial to have some type of enclosure that may be at least partially removed or retracted to open up at least a portion of the waterpark to the environment during good weather.

Positionable screens may be used to substantially enclose a portion of a waterpark during inclement weather. A multitude of positionable screens may be retractable/extendable within one another. The screens may also serve other functions in addition to protecting participants from uncomfortable weather conditions. The screens may be used to trap and recirculate heat lost from, for example, the water enclosed within the screens. The positioning of the screens may be automated, manual, or a combination of both. The screens may be formed from materials that allow most of the visible light spectrum through while inhibiting transmission of potentially harmful radiation.

Continuous water rides are dependent on reliable and enjoyable elevation systems. One such elevation system may include a ferris lock. A ferris lock may include one or more chambers capable of transporting participants and/or vehicles to different elevations within a waterpark. A rotational member coupled to the chambers may rotate the chamber between different elevation levels. The chambers may include retaining members to inhibit participants from exiting the chamber prematurely during use. Retaining members may be positionable to allow easier access to the chambers when motionless.

All of the above devices may be equipped with controller mechanisms configured to be operated remotely and/or automatically. For large water transportation systems measuring miles in length, a programmable logic control system may be used to allow park owners to operate the system effectively and cope with changing conditions in the system. During normal operating conditions, the control system may coordinate various elements of the system to control water flow. A pump shutdown will have ramifications both for water handling and guest handling throughout the system and will require automated control systems to manage efficiently. The control system may have remote sensors to report problems and diagnostic programs designed to identify problems and signal various pumps, gates, or other devices to deal with the problem as needed.

BRIEF DESCRIPTION OF THE DRAWINGS

Advantages of the present invention may become apparent to those skilled in the art with the benefit of the following detailed description of the preferred embodiments and upon reference to the accompanying drawings in which.

Figure 1:
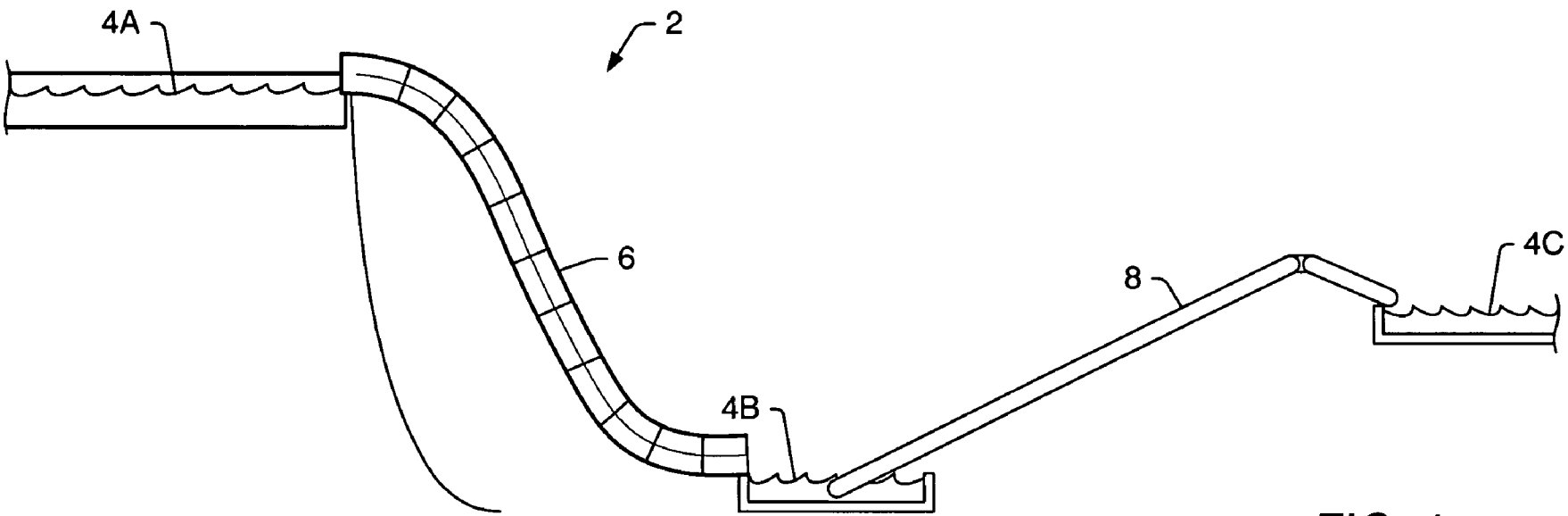
FIG. 1 depicts an embodiment of a portion of a continuous water slide.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

In some embodiments, a water amusement system (e.g., a waterpark) may include a "continuous water ride." The continuous water ride may allow a participant using the continuous water ride to avoid long lines typically associated with many water amusement systems. Long lines and/or wait times are one of the greatest problems associated with water amusement systems in the area of customer satisfaction.

Almost all water park rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

The concept of a continuous water ride was developed to address the problems and issues stated above associated with water amusement parks. Continuous water rides may assist in eliminating and/or reducing many long queue lines. Continuous water rides may eliminate and/or reduce participants having to walk back up to an entry point of a water ride. Continuous water rides may also allow the physically handicapped or physically challenged to take advantage of water amusement parks. Where before that may have been difficult if not impossible due to the many flights of stairs typically associated with water amusement parks.

In some embodiments, continuous water rides may include a system of individual water rides connected together. The system may include two or more water rides connected together. Water rides may include downhill water slides, uphill water slides, single tube slides, multiple participant tube slides, space bowls, sidewinders, interactive water slides, water rides with falling water, themed water slides, dark water rides, and/or accelerator sections in water slides. Connections may reduce long queue lines normally associated with individual water rides. Connections may allow participants to remain in the water and/or a vehicle (e.g., a floatation device) during transportation from a first portion of the continuous water ride to a second portion of the continuous water ride.

In some embodiments, an exit point of a first water ride may be connected to an entry point of a second water ride forming at least a portion of a continuous water ride. The exit point of the first water ride and the entry point of the second water ride may be at different elevation levels. An elevation system may be used to connect the exit point of the first water ride and the entry point of the second water ride. In some embodiments, an entry point of a second water ride may have a higher elevation than an exit point of a first water ride coupled to the entry point of the second water ride.

In some embodiments, elevation systems may include any system capable of transporting one or more participants and/or one or more vehicles from a first point at one elevation level to a second point at a different elevation level. Elevation systems may include a conveyor belt system. Elevation systems may include a water lock system. Elevation systems may include an uphill water slide, a spiral transport system, and/or a water wheel.

FIG. 1 depicts an embodiment of at least a portion of continuous water ride 2. Continuous water ride 2 may include body of water 4A. Body of water 4A may include pools, lakes, and/or wells. Body of water 4A may be natural, artificial, or an artificially modified natural body of water. A non-limiting example of an artificially modified natural body of water might include a natural lake which has been artificially enlarged and adapted for water amusement park purposes (e.g., entry ladders and/or entry steps). Continuous water ride 2 may include downhill water slide 6. Downhill water slide 6 may convey participants from body of water 4A at a first elevation to a lower second elevation into typically some type of water container (e.g., body of water, channel, floating queue line, and/or pool). The water container at the lower second elevation may include, for illustrative purposes only, second body of water 4B (e.g., a pool). Continuous water ride 2 may include elevation system 8. Elevation system 8 may include any system capable of safely moving participants and/or vehicles from a lower elevation to a higher elevation. Elevation system 8 is depicted as a conveyor belt system in FIG. 1. Elevation system 8 may convey participants to body of water 4C. FIG. 1 depicts merely a portion of one embodiment of continuous water ride 2.

Figure 2:
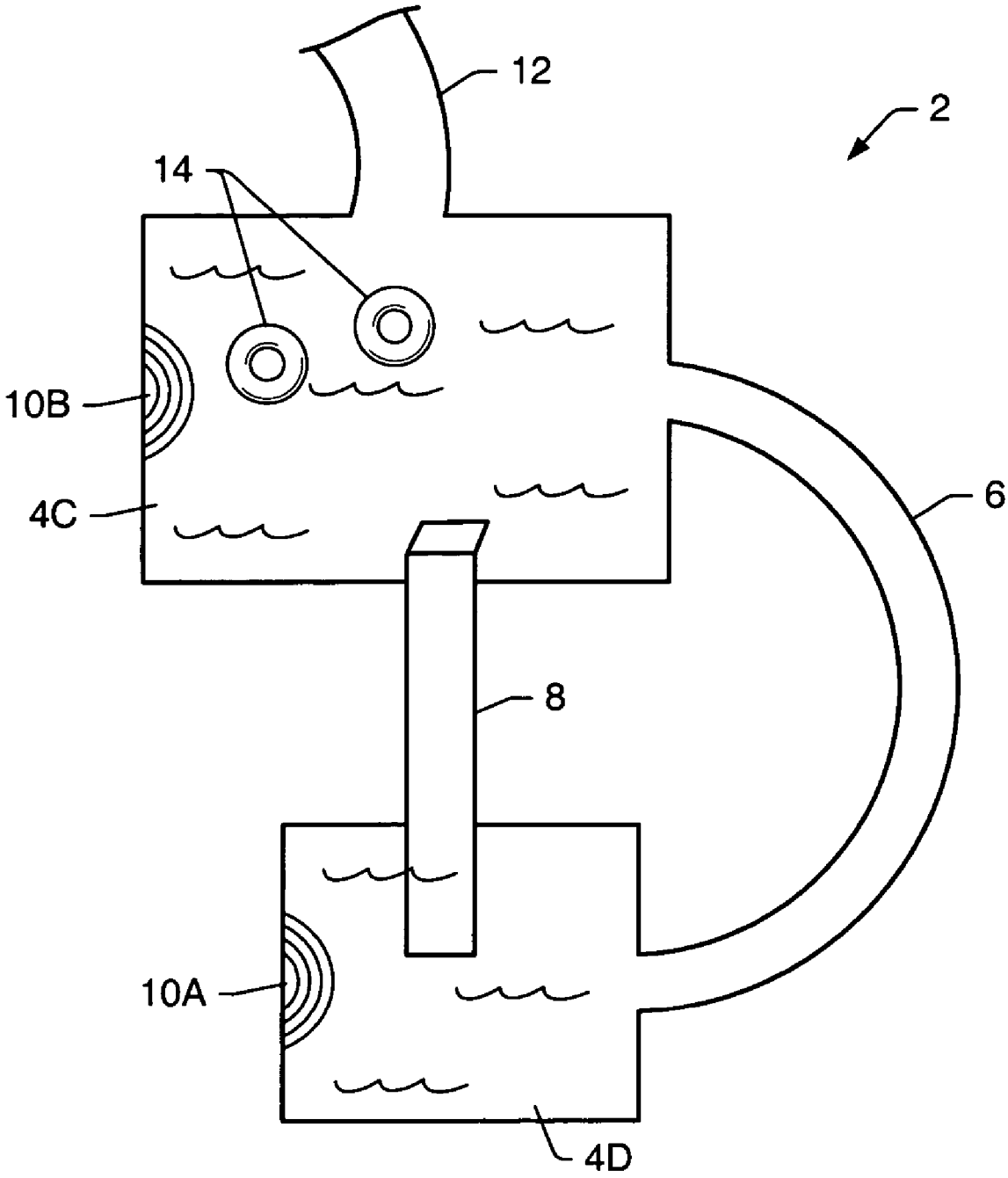
FIG. 2 depicts an embodiment of a portion of a continuous water slide.

FIG. 2 depicts an embodiment of a portion of continuous water ride 2. Continuous water ride 2 may include body of water 4C. Body of water 4C may be coupled to downhill water slide 6. Downhill water slide 6 may couple body of water 4C to body of water 4D. Body of water 4D may be positioned at a lower elevation than body of water 4C. Body of water 4D may include access point 10A. Access point 10A may allow participants to safely enter and/or exit body of water 4D. As depicted in FIG. 2 access points 10 may be stairs. Access points 10 may also include ladders and/or a gradually sloping walkway. Body of water 4D may be coupled to body of water 4C with elevation system 8. Elevation system 8 as depicted in FIG. 2 is a conveyor belt system. Elevation system 8 may be at least any system of elevation described herein. Body of water 4C may be coupled to a second water ride. The second water ride may be, for example, lazy river 12.

FIG. 2 depicts one small example of continuous water ride 2. Continuous water ride 2 may allow participants and/or their vehicles 14 (e.g., inner tubes) to ride continually without having to leave their vehicle. For example a participant may enter body of water 4C through access point 10B. The participant may ride vehicle 14 down downhill water slide 6 to body of water 4D. At this point the participant has the choice to exit body of water 4D at access point 10A or to ride their vehicle 14 up elevation system 8 to body of water 4C. For safety reasons one or both ends of elevation system 8 may extend below the surface of bodies of water 4. Extending the ends of elevation system 8 below the surface of the water may allow participants to float up on elevation system 8 more safely. Participants who choose to ride elevation system 8 to body of water 4C may then choose to either exit access point 10B, ride downhill water slide 6 again, or ride lazy river 12.

In some embodiments, bodies of water 4 may include multiple elevation systems 8 and multiple water rides connecting each other. In some embodiments, floating queue lines and/or channels may couple water rides and elevation systems. Floating queue lines may help control the flow of participants more efficiently than without using floating queue lines.

Figure 3:
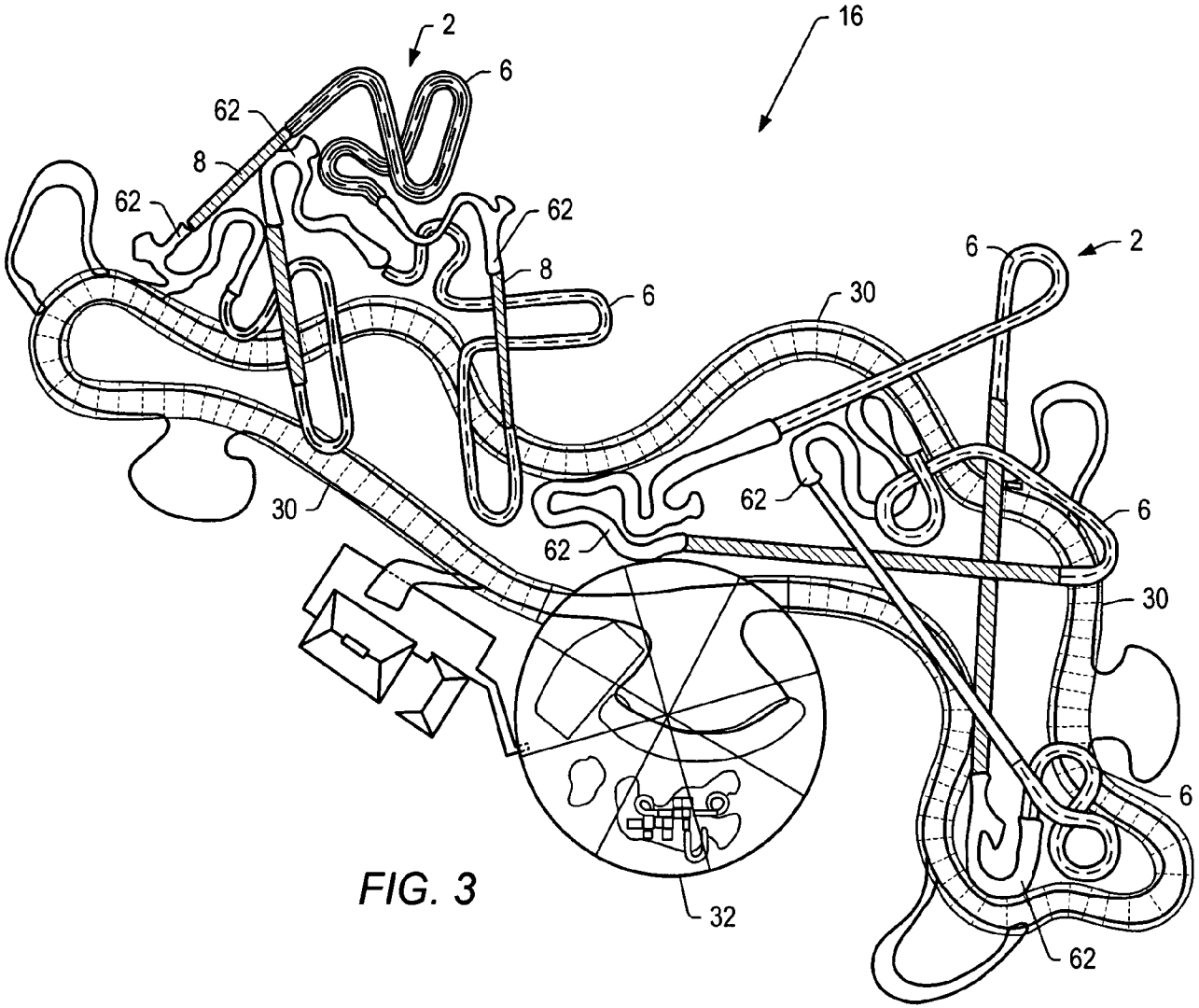
FIG. 3 depicts an embodiment of a water amusement park.

FIG. 3 depicts an embodiment of a water amusement park. Water amusement park 16 depicted in FIG. 3 shows several different examples of continuous water rides 2. Continuous water rides 2 may include elevation systems 8, downhill water slide 6, and floating queue systems 62. Elevation systems 8 may include, for example, conveyor belt systems as depicted in FIG. 3. Downhill water slides 6 may couple elevation systems 8 to floating queue systems 62.

In some embodiments, elevation systems may include a conveyor belt system. Conveyor belt systems may be more fully described in U.S. patent application Ser. No. 09/952,036 (Publication No. US-2002-0082097-A1), herein incorporated by reference. This system may include a conveyor belt system positioned to allow riders to naturally float up or swim up onto the conveyor and be carried up and deposited at a higher level.

The conveyor belt system may also be used to take riders and vehicles out of the water flow at stations requiring entry and/or exit from the continuous water ride. Riders and vehicles float to and are carried up on a moving conveyor on which riders may exit the vehicles. New riders may enter the vehicles and be transported into the continuous water ride at a desired location and velocity. The conveyor may extend below the surface of the water so as to more easily allow riders to naturally float or swim up onto the conveyor. Extending the conveyor below the surface of the water may allow for a smoother entry into the water when exiting the conveyor belt. Typically the conveyor belt takes riders and vehicles from a lower elevation to a higher elevation, however it may be important to first transport the riders to an elevation higher than the elevation of their final destination. Upon reaching this apex the riders then may be transported down to the elevation of their final destination on a water slide, rollers, or on a continuation of the original conveyor that transported them to the apex. This serves the purpose of using gravity to push the rider off and away from the belt, slide, or rollers into a second water ride of the continuous water ride and/or a floating queue. The endpoint of a conveyor may be near a first end of a horizontal hydraulic head channel wherein input water is introduced through a first conduit. This current of flowing water may move the riders away from the conveyor endpoint in a quick and orderly fashion so as not to cause increase in rider density at the conveyor endpoint. Further, moving the riders quickly away from the conveyor endpoint may act as a safety feature reducing the risk of riders becoming entangled in any part of the conveyor belt or its mechanisms. A deflector plate may also extend from one or more ends of the conveyor and may extend to the bottom of the channel. When the deflector plate extends at an angle away from the conveyor it may help to guide the riders up onto the conveyor belt as well as inhibit access to the rotating rollers underneath the conveyor. These conveyors may be designed to lift riders from one level to a higher one, or may be designed to lift riders and vehicles out of the water, onto a horizontal moving platform and then return the vehicle with a new rider to the water.

The conveyor belt speed may also be adjusted in accordance with several variables. The belt speed may be adjusted depending on the rider density; for example, the speed may be increased when rider density is high to reduce rider waiting time. The speed of the belt may be varied to match the velocity of the water, reducing changes in velocity experienced by the rider moving from one medium to another (for example from a current of water to a conveyor belt). Decreasing changes in velocity is an important safety consideration due to the fact that extreme changes in velocity may cause a rider to become unbalanced. Conveyor belt speed may be adjusted so riders are discharged at predetermined intervals, which may be important where riders are launched from a conveyor to a water ride that requires safety intervals between the riders.

Several safety concerns should be addressed in connection with the conveyor system. The actual belt of the system should be made of a material and designed to provide good traction to riders and vehicles without proving uncomfortable to the riders touch. The angle at which the conveyor is disposed is an important safety consideration and should be small enough so as not to cause the riders to become unbalanced or to slide in an uncontrolled manner along the conveyor belt. Detection devices or sensors for safety purposes may also be installed at various points along the conveyor belt system. These detection devices may be variously designed to determine if any rider on the conveyor is standing or otherwise violating safety parameters. Gates may also be installed at the top or bottom of a conveyor, arranged mechanically or with sensors wherein the conveyor stops when the rider collides with the gate so there is no danger of the rider being caught in and pulled under the conveyor. Runners may cover the outside edges of the conveyor belt covering the space between the conveyor and the outside wall of the conveyor so that no part of a rider may be caught in this space. All hardware (electrical, mechanical, and otherwise) should be able to withstand exposure to water, sunlight, and various chemicals associated with water treatment (including chlorine or fluorine) as well as common chemicals associated with the riders themselves (such as the various components making up sunscreen or cosmetics).

Various sensors may also be installed along the conveyor belt system to monitor the number of people using the system in addition to their density at various points along the system. Sensors may also monitor the actual conveyor belt system itself for breakdowns or other problems. Problems include, but are not limited to, the conveyor belt not moving when it should be or sections broken or in need of repair in the belt itself. All of this information may be transferred to various central or local control stations where it may be monitored so adjustments may be made to improve efficiency of transportation of the riders. Some or all of these adjustments may be automated and controlled by a programmable logic control system.

Various embodiments of the conveyor lift station include widths allowing only one or several riders side by side to ride on the conveyor according to ride and capacity requirements. The conveyor may also include entry and exit lanes in the incoming and outgoing stream so as to better position riders onto the conveyor belt and into the outgoing stream.

Figure 4:
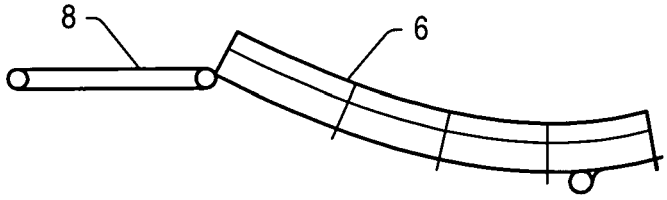
FIG. 4 depicts a side view of an embodiment of a conveyor lift station coupled to a water ride.
Figure 5:
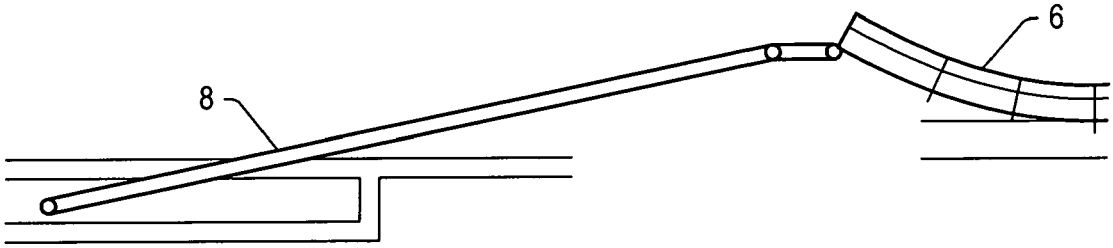
FIG. 5 depicts a side view of an embodiment of a conveyor lift station with an entry conveyor coupled to a water slide.
Figure 6:
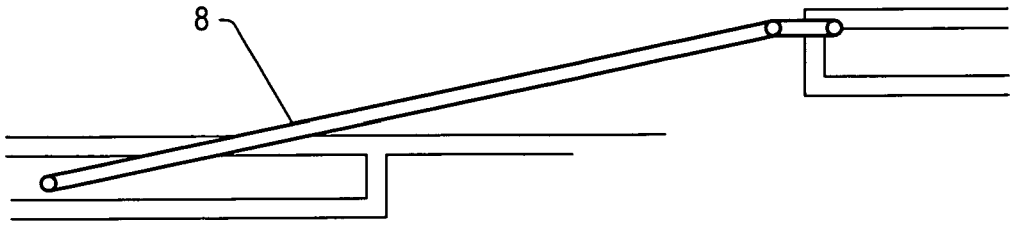
FIG. 6 depicts a side view of an embodiment of a conveyor lift station coupled to an upper channel.

More embodiments of conveyor systems are shown in FIGS. 4–6. FIG. 4 shows a dry conveyor 8 for transporting riders entering the system into a channel. It includes a conveyor belt portion ending at the top of downhill slide 6 which riders slide down on into the water. FIG. 5 shows a wet conveyor 8 for transporting riders from a lower channel to a higher one with downhill slide 6 substituted for the launch conveyor. FIG. 6 shows a river conveyor 8 for transporting riders from a channel to a lazy river. This embodiment does not have a descending portion.

In some embodiments, an elevation system may include a water lock system. These systems may be used to increase elevation and/or decrease elevation. In certain embodiments, an exit point of a first water ride of a continuous water ride may have an elevation below an entry point of a second water ride of the continuous water ride. In some embodiments, the water lock system includes a chamber for holding water coupled to the exit point of the first water ride and the entry point of the second water ride. A chamber is herein defined as an at least partially enclosed space. The chamber includes at least one outer wall, or a series of outer walls that together define the outer perimeter of the chamber. The chamber may also be at least partially defined by natural features such as the side of a hill or mountain. The walls may be substantially watertight. The outer wall of the chamber, in certain embodiments, extends below an upper surface of the first water ride and above the upper surface of the second water ride. The chamber may have a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

A first movable member may be formed in the outer wall of the chamber. The first movable member may be positioned to allow participants and water to move between the exit point of the first water ride and the chamber when the first movable member is open during use. A second movable member may be formed in the wall of the chamber. The second movable member may be positioned to allow participants and water to move between the entry point of the second water ride and the chamber when the second movable member is open during use. The second movable member may be formed in the wall at an elevation that differs from that of the first movable member.

In certain embodiments, the first and second movable members may be configured to swing away from the chamber wall when moving from a closed position to an open position during use. In certain embodiments, the first and second movable members may be configured to move vertically into a portion of the wall when moving from a closed position to an open position. In certain embodiments, the first and second movable members may be configured to move horizontally along a portion of the wall when moving from a closed position to an open position.

A bottom member may also be positioned within the chamber. The bottom member may be configured to float below the upper surface of water within the chamber during use. The bottom member may be configured to rise when the water in the chamber rises during use. In certain embodiments, the bottom member is substantially water permeable such that water in the chamber moves freely through the bottom member as the bottom member is moved within the chamber during use. The bottom member may be configured to remain at a substantially constant distance from the upper surface of the water in the chamber during use. The bottom member may include a wall extending from the bottom member to a position above the upper surface of the water. The wall may be configured to prevent participants from moving to a position below the bottom member. A floatation member may be positioned upon the wall at a location proximate the upper surface of the water. A ratcheted locking system may couple the bottom member to the inner surface of the chamber wall. The ratcheted locking system may be configured to inhibit the bottom member from sinking when water is suddenly released from the chamber. The ratcheted locking system may also include a motor to allow the bottom member to be moved vertically within the chamber. There may be one or more bottom members positioned within a single chamber. The bottom member may incorporate water jets to direct and/or propel participants in or out of the chamber.

The lock system may also include a substantially vertical first ladder coupled to the wall of the bottom member and a substantially vertical second ladder coupled to a wall of the chamber. The first and second ladders, in certain embodiments, are positioned such that the ladders remain substantially aligned as the bottom member moves vertically within the chamber. The second ladder may extend to the top of the outer wall of the chamber. The ladders may allow participants to exit from the chamber if the lock system is not working properly.

In certain embodiments, water may be transferred into and out of the water lock system via the movable members formed within the chamber wall. Opening of the movable members may allow water to flow into the chamber from the second water ride or out of the chamber into the first water ride.

The lock system may also include a controller for operating the system. The automatic controller may be a computer, programmable logic controller, or any other control device. The controller may be coupled to the first movable member, the second movable member, and the first water control system. The controller may allow manual, semi-automatic, or automatic control of the lock system. The automatic controller may be connected to sensors positioned to detect if people are in the lock or not, blocking the gate, or if the gate is fully opened or fully closed or the water levels within the chambers.

In certain embodiments, the participants may be floating in water during the entire transfer from the first water ride to the second water ride. The participants may be swimming in the water or floating upon a floatation device. Participants may float on an inner tube, a floatation board, raft, or other floatation devices used by riders on water rides.

In certain embodiments, the lock system may include multiple movable members formed within the outer wall of the chamber. These movable members may lead to multiple water rides and/or continuous water ride systems coupled to the chamber. The additional movable members may be formed at the same elevational level or at different elevations.

In some embodiments, a first and second movable members formed in the outer wall of a chamber of a lock system may be configured to move vertically into a portion of the wall when moving from a closed position to an open position. The members may be substantially hollow, and have holes in the bottom configured to allow fluid flow in and out of the member. In an open position, the hollow member may be substantially filled with water. To move the member to a closed position, compressed air from a compressed air source may be introduced into the top of the hollow member through a valve, forcing water out of the holes in the bottom of the member. As the water is forced out and air enters the member, the buoyancy of the member may increase and the member may float up until it reaches a closed position. In this closed position, the holes in the bottom of the member may remain submerged, thereby preventing the air from escaping through the holes. To move the member back to an open position, a valve in the top of the member may be opened, allowing the compressed air to escape and allowing water to enter through the holes in the bottom. As water enters and compressed air escapes, the gate may lose buoyancy and sink until it reaches the open position, when the air valve may be closed again.

An advantage to the pneumatic gate system may be that water may be easily transferred from a higher lock to a lower one over the top of the gate. This system greatly simplifies and reduces the cost of valves and pumping systems between lock levels. The water that progressively spills over the top of the gate as it is lowered is at low, near-surface pressures in contrast to water pouring forth at various pressures in a swinging gate lock system. This advantage makes it feasible to eliminate some of the valves and piping required to move water from a higher lock to a lower lock.

In certain embodiments a pneumatic or hydraulic cylinder may be used to vertically move a gate system. An advantage to this system may be that the operator has much more control over the gate than with a gate system operating on a principle of increasing and decreasing the buoyancy. More control of the gate system may allow the gates to be operated in concert with one another, as well as increasing the safety associated with the system. The gate may be essentially hollow and filled with air or other floatation material such as Styrofoam, decreasing the power needed to move the gate.

While described as having only a single chamber coupled to two water rides forming a continuous water ride, it should be understood that multiple chambers may be interlocked to couple two or more water rides of a first continuous water ride and/or a second continuous water ride. By using multiple chambers, a series of smaller chambers may be built rather than a single large chamber. In some situations it may be easier to build a series of chambers rather than a single chamber. For example, use of a series of smaller chambers may better match the slope of an existing hill. Another example is to reduce water depths and pressures operating in each chamber so as to improve safety and reduce structural considerations resulting from increased water pressure differentials. Another example is the use of multiple chambers to increase aesthetics or ride excitement. Another is the use of multiple chambers to increase overall speed and rider throughput of the lock.

The participants may be transferred from the first water ride to the second water ride by entering the chamber and altering the level of water within the chamber. The first movable member, coupled to the first water ride is opened to allow the participants to move into the chamber. The participants may propel themselves by pulling themselves along by use of rope or other accessible handles or be pushed directly with water jets or be propelled by a current moving from the lower water ride toward the chamber. The current may be generated using water jets positioned along the inner surface of the chamber. Alternatively, a current may be generated by altering the level of water in the first water ride. For example, by raising the level of water in the first water ride a flow of water from the first water ride into the chamber may occur.

After the participants have entered the chamber, the first movable member is closed and the level of water in the chamber is altered. The level may be raised or lowered, depending on the elevation level of the second water ride with respect to the first water ride. If the second water ride is higher than the first water ride, the water level is raised. If the first water ride is at a higher elevation than the second water ride, the water level is lowered. As the water level in the chamber is altered, the participants are moved to a level commensurate with the upper surface of the second water ride. While the water level is altered within the chamber, the participants remain floating proximate the surface of the water. A bottom member preferably moves with the upper surface of the water in the chamber to maintain a relatively constant and safe depth of water beneath the riders. The water level in the chamber, in certain embodiments, is altered until the water level in the chamber is substantially equal to the water level of the second water ride. The second movable member may now be opened, allowing the participants to move from the chamber to the second water ride. In certain embodiments, a current may be generated by filling the chamber with additional water after the level of water in the chamber is substantially equal to the level of water outside the chamber. As the water is pumped in the chamber, the resulting increase in water volume within the chamber may cause a current to be formed flowing from the chamber to the water ride. When the movable member is open, the formed current may be used to propel the participants from the chamber to a water ride. Thus, the participants may be transferred from a first water ride to a second water ride without having to leave the water forming a continuous water ride. The participants are thus relieved of having to walk up a hill. The participants may also be relieved from carrying any floatation devices necessary for the continuous water ride.

Figure 7:
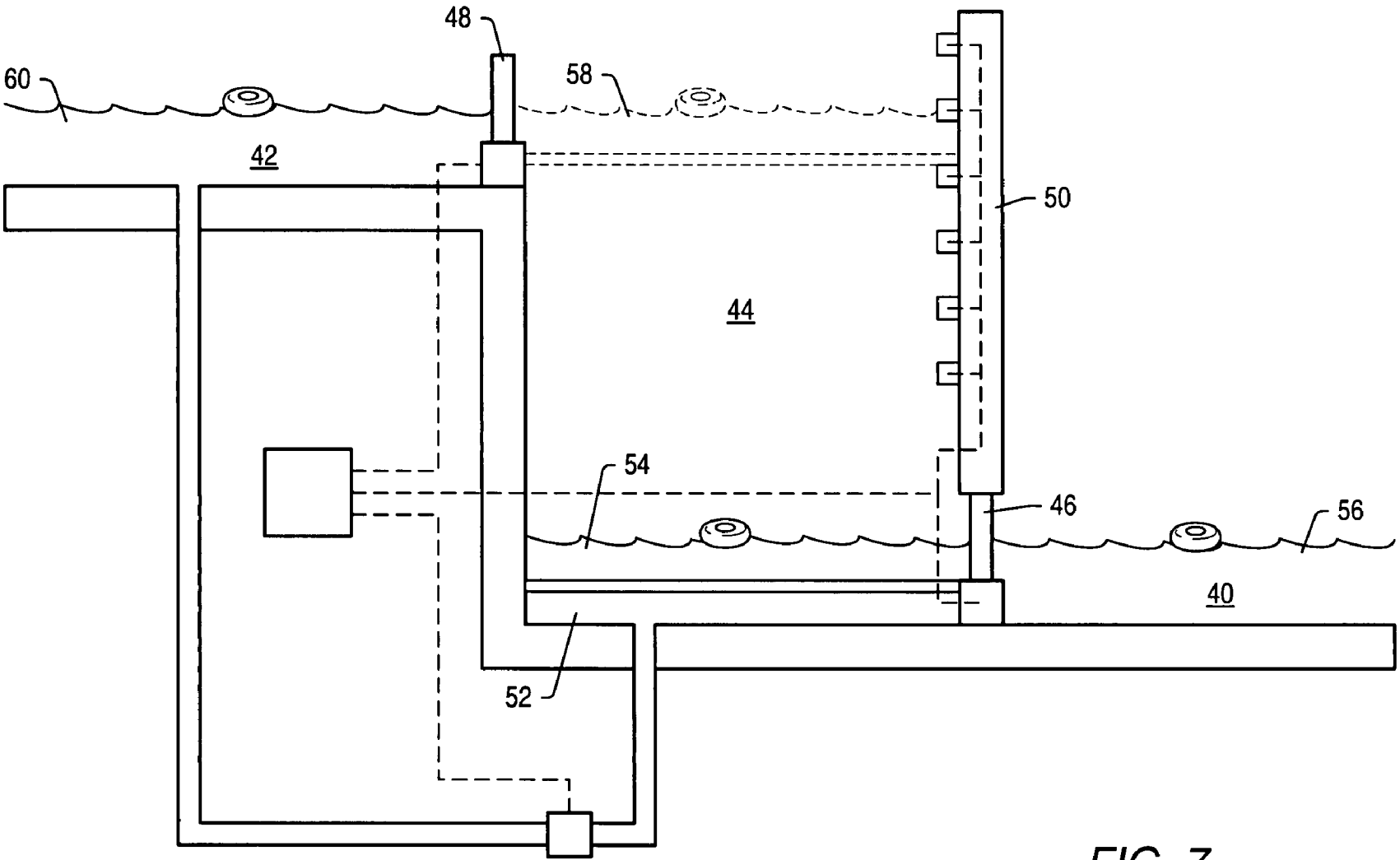
FIG. 7 depicts a cross-sectional side view of an embodiment of a water lock system with one chamber and a conduit coupling the upper body of water to the chamber.

FIG. 7 depicts a water lock system for conveying a person or a group of people (i.e., the participants) from a lower body of water 40 to an upper body of water 42. It should be understood that while a system and method of transferring the participants from the lower body of water to the upper body of water is herein described, the lock system may also be used to transfer participants from an upper body to a lower body, by reversing the operation of the lock system. The upper and lower bodies of water may be receiving pools (i.e., pools positioned at the end of a water ride), entry pools (i.e., pools positioned to at the entrance of a water ride), another chamber of a water lock system, or a natural body of water (e.g., a lake, river, reservoir, pond, etc.). The water lock system, in certain embodiments, includes at least one chamber 44 coupled to the upper and lower bodies of water. First movable member 46 and second movable member 48 may be formed in an outer wall 50 of the chamber. First movable member 46 may be coupled to lower body of water 40 such that the participants may enter chamber 44 from the lower body of water while the water 52 in the chamber is at level 54 substantially equal to upper surface 56 of the lower body of water. After the participants have entered chamber 44, the level of water within the chamber may be raised to a height 58 substantially equal to upper surface 60 of upper body of water 42. Second movable member 48 may be coupled to upper body of water 42 such that the participants may move from chamber 44 to the upper body of water after the level of water in the chamber is raised to the appropriate height.

Outer wall 50 of chamber 44 may be coupled to both lower body of water 40 and upper body of water 42. Outer wall 50 may extend from a point below upper surface 56 of lower body of water 40 to a point above upper surface 60 of upper body of water 42. Water lock systems may be more fully described in U.S. patent application Ser. No. 09/952,036.

In some embodiments, elevation systems may not be mere systems of conveyance to different elevation levels. Elevations systems may be designed to be entertaining and an enjoyable part of the water ride as well as the water rides of the continuous water ride which the elevation system is connecting. For example, when the elevation system includes an uphill water slide, the entertainment value may be no less for the elevation system of the continuous water ride than for the connected water rides.

In some embodiments, elevation systems may be part of the entertainment experience (e.g., uphill water slides). In certain embodiments, an elevation system may include a "ferris lock." The ferris lock being so named due to its similarity to a combination between a Ferris wheel and a water lock system as described herein. The ferris lock may include a chamber for holding water. The chamber may be configurable to hold one or more vehicles. The vehicles may be flexible. The vehicles may be inflatable (e.g., inner tubes). A rotational member may be coupled to the chamber. The rotational member may rotate the chamber between different elevation levels. There may be two or more elevation levels.

In some embodiments, different elevation levels of a ferris lock may include an entry point to a portion of a water amusement park (e.g., a water amusement ride). Different elevational levels of a ferris lock may include an entry and an exit point of two different portions of a water amusement park on the same elevation level. A chamber of a ferris lock may carry one or more vehicles and/or participants from one elevation level to another.

In some embodiments, a ferris lock system may include one or more safety features to prevent injury during use. One example of a safety feature may include retaining members coupled to a chamber of the ferris lock. Retaining members may inhibit vehicles from moving into or out of the chamber while moving between different elevation levels. Walls of the chamber may act naturally as retaining members if they are high enough relative to the water level in the chamber. However if the walls of the chamber are used as retaining members, this does not allow participants to see their surrounding environment very well during the ride. Not allowing participants to see their surrounding environment may reduce the entertainment factor of the ride. To overcome this problem the retaining members may be made of some type of bars, epoxy coated wire mesh, and/or plastic netting. In some embodiments, retaining members may be formed from thick sheets of glass or translucent polymers (e.g., polycarbonate). In one example, substantially all or most of chamber may be formed from translucent or substantially translucent materials. Providing a similar effect as demonstrated in, for example, glass bottomed boats.

In some embodiments, a ferris lock system may include a chamber where water levels within the chamber are kept intentionally low. Optimally water levels may be kept at a point where vehicles within the chamber freely float. As a safety feature water levels may be kept at a level which allows most participants to stand within the chamber and still keep at least their head above water. Keeping the water at such a low level may inhibit accidental drowning. Water levels within the chamber may be maintained any number of ways. Retaining members may be designed to keep vehicles and participants in the chamber while allowing water to drain off to an appropriate level in the chamber. Drain holes may bored into sides of the chambers at an appropriate level to allow excess water to drain out of the chamber during use.

In some embodiments, a chamber of a ferris lock may include a movable member. The movable member may act as a gate between the chamber and each elevation level. The movable member when in a first position may act to inhibit anything contained in the chamber from exiting (e.g., water, vehicles and/or participants). The movable member when in a second position may allow participants and/or vehicles to exit the chamber. Movable members may operate in a similar fashion to movable members as described in U.S. patent application Ser. No. 09/952,036 as regards water locks. Participants may exit the chamber under their own power. In some embodiments, participants/vehicles may be assisted in exiting a chamber. For example, water jets (depicted in FIG. 8), as described in U.S. patent application Ser. No. 09/952,036 as regards floating queue lines, may be used to direct participants out of the chamber. The water level in the chamber may be higher than the water level at an elevation level stop. The higher water level in the chamber may be due, for example, to the water being deeper in the chamber than in the elevation level stop. The higher water level in the chamber may be due, for example, to the chamber being designed to actually stop at a higher elevation level than the elevation level stop. When the movable member is moved to the second position, allowing participants to exit the chamber, and the water in the chamber is at a higher level, the movement of water from the chamber to the elevation level stop may assist participant/vehicles in moving into the elevation level stop.

In some embodiments, different elevation levels may include similar movable members as described regarding ferris lock chambers. The elevation level movable members may work in combination with chamber movable members to allow participants to exit and enter the ferris lock chamber.

In some embodiments, movable members may not be necessary to allow exit or entry into a chamber of a ferris lock. For example one elevational level may include a body of water. The body of water may be a natural or man made pool or lake. The chamber of the ferris lock may rotate to a position lower than the surface level of the lake. The chamber lowering to a level below the surface of the lake would allow participants to enter or exit the chamber safely. In some embodiments, all of the chamber except the retaining member may be below water. At least one of the retaining members may be positionable so as to allow access to the chamber. Once in the chamber, a participant and/or operator may reposition the retaining member so as to inhibit the participant from exiting the chamber while it is moving.

Figure 9:
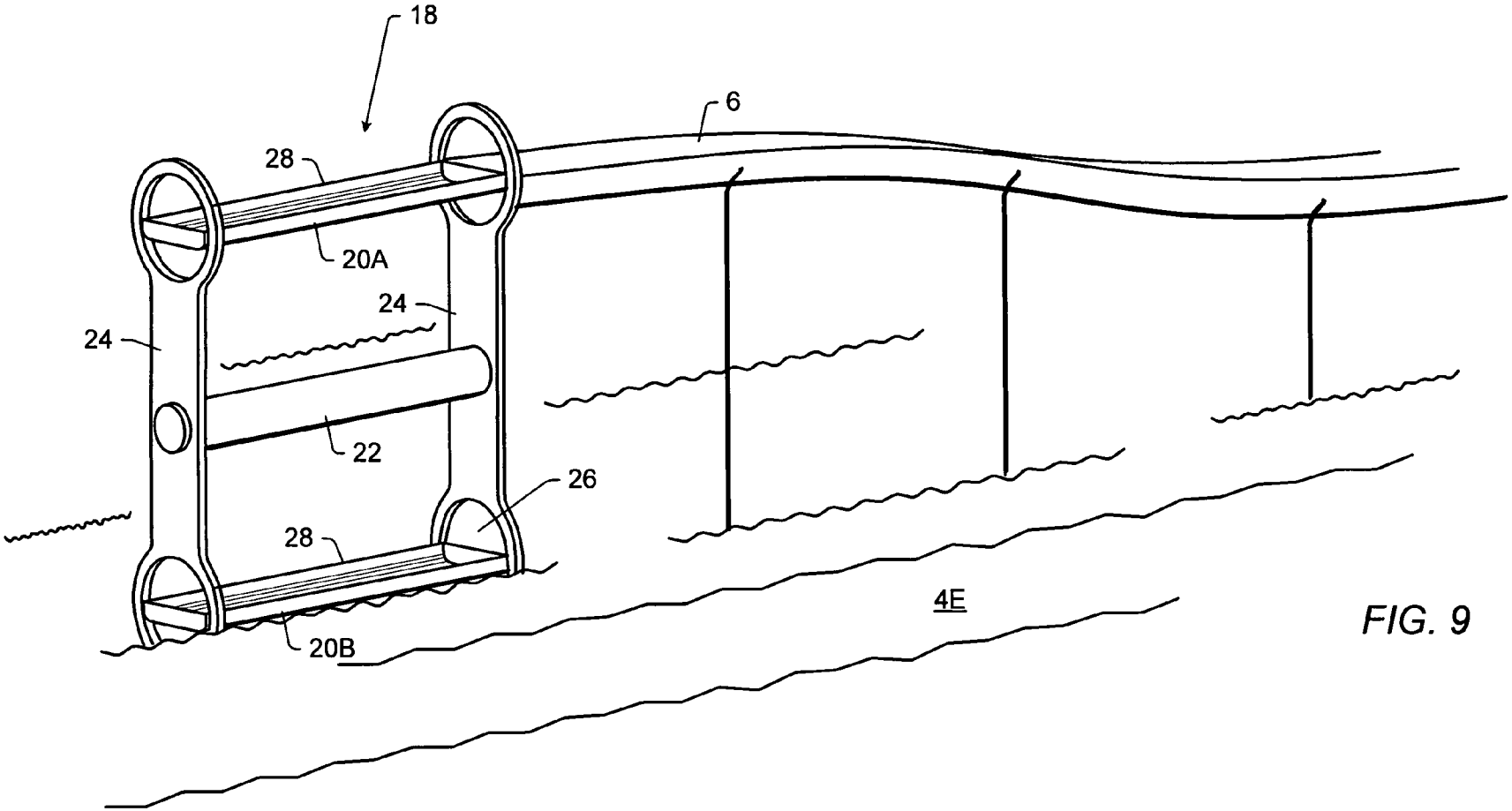
FIG. 9 depicts an embodiment of a ferris lock with two chambers.

FIG. 9 depicts an embodiment of ferris lock 18. Ferris lock 18 may include chambers 20A–B and rotational member 22. Chambers 20A–B may be coupled to rotational member 22. Chambers 20A–B may be coupled to rotational member 22 using supports 24. Rotational member 22 may be coupled to a power source and/or engine (not shown). Rotational member 22 may rotate. Rotation of rotational member 22 may rotate supports 24 and chambers 20A–B. Chambers 20A–B may contain water during use. Water contained within chambers 20A–B may be of a level low enough to allow most participants to stand and keep at least their head above water, while still allowing participant vehicles contained within chambers 20A–B to float. For example, water in chambers 20A–B may be no more than about 3 feet deep and no less than about 1 foot deep. In some embodiments, water in chambers 20A–B may be no more than about 4 feet deep and no less than about 2 foot deep. Rotation of chambers 20A–B may transport vehicles and/or participants from body of water 4E to an entry point of downhill water slide 6. Supports 24 may include openings 26. Ends of chambers 20A–B may sit within openings 26. Ends of chambers 20A–B may sit within tracks in openings 26. Tracks within openings 26 may allow chambers 20A–B to rotate freely within openings 26. Freely rotating chambers 20A–B may allow chambers 20A–B to remain upright safely transporting participants between different elevational heights. Appropriate measures may be taken to ensure chambers 20A–B remain upright, for example, adding weight to the bottom of chambers 20A–B to inhibit chambers 20A–B from flipping over. Chambers 20A–B may include retaining members 28. Retaining members 28 may inhibit participants and/or vehicles from exiting chambers 20A–B while they are moving. Chambers 20A–B may be designed to hold any number of participants and/or vehicles. Ferris lock 18 is depicted in FIG. 9 with only two chambers 20, however, ferris lock 18 may be designed with three or more chambers 20 coupled to rotational member 22.

Figure 10:
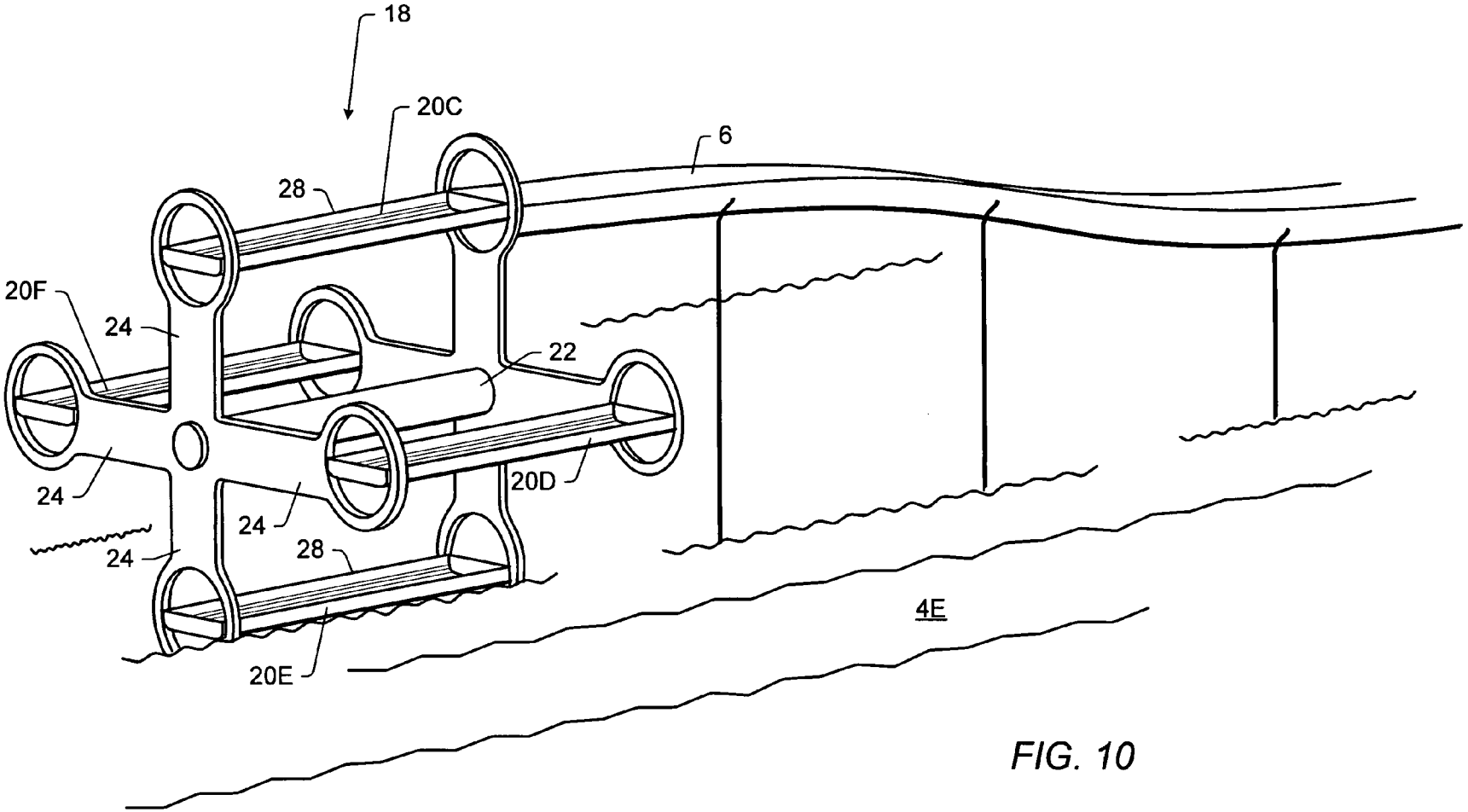
FIG. 10 depicts an embodiment of a ferns lock with four chambers.

FIG. 10 depicts an embodiment of a ferris lock. Ferris lock 18 may function similarly to ferris lock 18 depicted in FIG. 9. Ferris lock 18 may include chambers 20C–F and rotational member 22. Chambers 20C–E may be coupled to rotational member 22. Chambers 20C–F may be coupled to rotational member 22 using supports 24. Ferris lock 18 depicted in FIG. 10 may include four chambers 20C–F coupled to rotational member 22.

In some embodiments, an exit point of a second water ride of a continuous water ride may be coupled to an entry point of a first water ride. Coupling the exit point of the second water ride to the entry point of the first water ride may form a true continuous water ride loop. The continuous water ride may include a second elevation system coupling the exit point of the second water ride to the entry point of the first water ride. The second elevation system may include any of the elevation systems described for use in coupling an exit point of the first water ride to the entry point of the second water ride. The second elevation system may be a different elevation system than the first elevation system. For example, the first elevation system may be an uphill water slide and the second water elevation system may be a conveyor belt system.

In some embodiments, a continuous water ride may include one or more floating queue lines. Floating queue lines may be more fully described in U.S. Patent Publication No. 20020082097. Floating queue lines may assist in coupling different portions of a continuous water ride. Floating queue line systems may be used for positioning riders in an orderly fashion and delivering them to the start of a ride at a desired time. In certain embodiments, this system may include a channel (horizontal or otherwise) coupled to a ride on one end and an elevation system on the other end. It should be noted, however, that any of the previously described elevation systems may be coupled to the water ride by the floating queue line system. Alternatively, a floating queue line system may be used to control the flow of participants into the continuous water ride from a dry position within a station.

In use, riders desiring to participate on a water ride may leave the body of water and enter the floating queue line. The floating queue line may include pump inlets and outlets similar to those in a horizontal channel but configured to operate intermittently to propel riders along the queue line, or the inlet and outlet may be used solely to keep a desired amount of water in the queue line. In the latter case, the channel may be configured with high velocity low volume jets that operate intermittently to deliver participants to the end of the queue line at the desired time.

In certain embodiments, the water moves participants along the floating queue line down a hydraulic gradient or bottom slope gradient. The hydraulic gradient may be produced by out-flowing the water over a weir at one end of the queue after the rider enters the ride to which the queue line delivers them, or by out-flowing the water down a bottom slope that starts after the point that the rider enters the ride. In certain embodiments, the water moves through the queue channel by means of a sloping floor. The water from the outflow of the queue line in any method can reenter the main channel, another ride or water feature/s, or return to the system sump. Preferably the water level and width of the queue line are minimized for water depth safety, rider control and water velocity. These factors combined deliver the participants to the ride in an orderly and safe fashion, at the preferred speed, with minimal water volume usage. The preferred water depth, channel width and velocity would be set by adjustable parameters depending on the type of riding vehicle, participant comfort and safety, and water usage. Decreased water depth may also be influenced by local ordinances that determine level of operator or lifeguard assistance, the preferred being a need for minimal operator assistance consistent with safety.

In some embodiments, continuous water rides may include exits or entry points at different portion of the continuous water ride. Floating queue lines coupling different portions and/or rides forming a continuous water ride may include exit and/or entry points onto the continuous water ride. Exit/entry points may be used for emergency purposes in case of, for example, an unscheduled shutdown of the continuous water ride. Exit/entry points may allow participants to enter/exit the continuous water ride at various designated points along the ride during normal use of the continuous water ride. Participants entering/exiting the continuous water ride during normal use of the ride may not disrupt the normal flow of the ride depending on where the entry/exit points are situated along the course of the ride.

Embodiments disclosed herein provide an interactive control system for a continuous water ride and/or portions of the continuous water ride. In certain embodiments, the control system may include a programmable logic controller. The control system may be coupled to one or more activation points, participant detectors, and/or flow control devices. One or more other sensors may be coupled to the control system. The control system may be utilized to provide a wide variety of interactive and/or automated water features. In some embodiments, participants may apply a participant signal to one or more activation points. The activation points may send activation signals to the control system in response to the participant signals. The control system may be configured to send control signals to a water system, a light system, and/or a sound system in response to a received activation signal from an activation point. A water system may include, for example, a water effect generator, a conduit for providing water to the water effect generator, and a flow control device. The control system may send different control signals depending on which activation point sent an activation signal. The participant signal may be applied to the activation point by the application of pressure, moving a movable activating device, a gesture (e.g., waving a hand), interrupting a light beam, a participant identifier and/or by voice activation. Examples of activation points include, but are not limited to, hand wheels, push buttons, optical touch buttons, pull ropes, paddle wheel spinners, motion detectors, sound detectors, and levers.

The control system may be coupled to sensors to detect the presence of a participant proximate to the activation point. The control system may be configured to produce one or more control systems to active a water system, sound system, and/or light system in response to a detection signal indicating that a participant is proximate to an activation point. The control system may also be coupled to flow control devices, such as, but not limited to: valves, and pumps. Valves may includes air valves and water valves configured to control the flow air or water, respectively, through a water feature. The control system may also be coupled to one or more indicators located proximate to one or more activation points. The control system may be configured to generate and send indicator control signals to turn an indicator on or off. The indicators may signal a participant to apply a participant signal to an activation point associated with each indicator. An indicator may signal a participant via a visual, audible, and/or tactile signal. For example, an indicator may include an image projected onto a screen.

In some embodiments, the control system may be configured to generate and send one or more activation signals in the absence of an activation signal. For example, if no activation signal is received for a predetermined amount of time, the control system may produce one or more control signals to activate a water system, sound system, and/or light system.

Throughout the system electronic signs or monitors may be positioned to notify riders or operators of various aspect of the system including, but not limited to: operational status of any part of the system described herein above; estimated waiting time for a particular ride; and possible detours around non operational rides or areas of high rider density.

In some embodiments, a water amusement park may include a cover or a screen. Screens may be used to substantially envelope or cover a portion of a water amusement park. Portions of the screen may be positionable. Positionable screen portions may allow portions of the park to be covered or uncovered. The decision to cover or uncover a portion of the water amusement park may be based on the weather. Inclement weather may prompt operators to cover portions of the water park with the positionable screens. While clear warm weather may allow operators to move the positionable screen so portions of the water amusement park remain uncovered.

In some embodiments, positionable screens may be formed from substantially translucent materials. Translucent materials may allow a portion of the visible light spectrum to pass through the positionable screens. Translucent materials may inhibit transmittance of certain potentially harmful portions of the light spectrum (e.g., ultraviolet light). Filtering out a potentially harmful portion of the light spectrum may provide added health benefits to the water amusement park relative to uncovered water amusement parks. A non-limiting example of possible screen material may include Foiltech. Foiltech has an R protective value of about 2.5. A non-limiting example of possible screen material may include polycarbonates. Polycarbonates may have an R protective value of about 2. In some embodiments, multiple layers of screen material (e.g., polycarbonate) may be used. Using multiple layers of screen material may increase a screen materials natural thermal insulating abilities among other things. Portions of the screening system described herein may be purchased commercially at Arqualand in the United Kingdom.

In some embodiments, portions of the positionable screen may assist in collecting solar radiation. Solar radiation collected by portions of the positionable screen may be used to increase the ambient temperature in the area enclosed by the screen. Increasing the ambient temperature in enclosed portions of the water amusement park using collected solar radiation may allow the water amusement park to remain open to the public even when the outside temperature is uncomfortably cold and unconducive to typical outside activities.

In some embodiments, positionable screens may be used to enclose portions of a water amusement park. Enclosed areas of the water amusement park may function as a heat sink. Heat emanating from bodies of water within the enclosed area of the water amusement park may be captured within the area between the body of water and the positionable screens. Heat captured under the positionable screens may be recirculated back into the water. Captured heat may be recirculated back into the water using heat pumps and/or other common methods known to one skilled in the art.

In some embodiments, screens may be mounted on wheels and/or rollers. Screen may be formed from relatively light but strong materials. For example panels may be formed from polycarbonate for other reasons described herein, while structural frameworks supporting these panels may be formed from, for example, aluminum. Lightweight, well-balanced, support structures on wheels/rollers might allow screens to be moved manually by only a few operators. Operators might simply push screens into position. Mechanisms may installed to assist operators in manually positioning screens (e.g., tracks, pulley mechanisms).

Examples of systems which facilitate movement of screens over bodies of water and/or channels (e.g., track based systems) are illustrated in U.S. Pat. No. 4,683,686 to Ozdemir and U.S. Pat. No. 5,950,253 to Last, each of which is incorporated by reference as if fully set forth herein.

In some positionable screen embodiments, screens may be moved using automated means. Powered engines (e.g., electrically driven) may be used to move positionable screens around using central control systems. Control systems may be automated to respond to input from sensors designed to track local weather conditions. For example, sensors may detect when it is raining and/or the temperature. When it begins to rain and/or the temperature drop below a preset limit an automated control system may move positionable screen to enclose previously unenclosed portions of the water amusement park.

Figure 11:
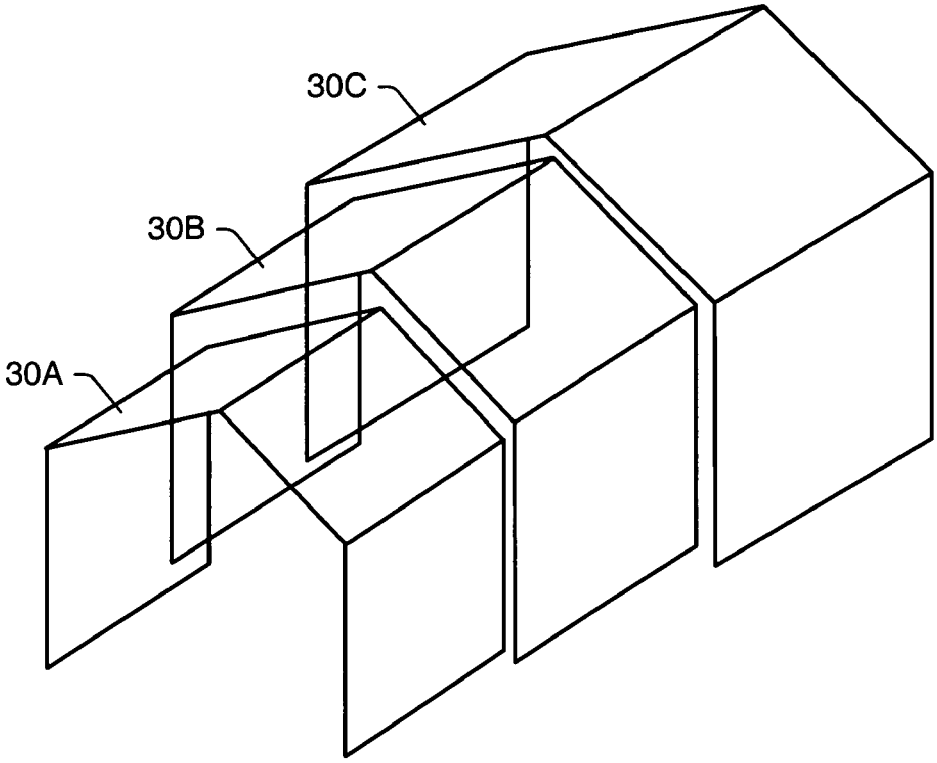
FIG. 11 depicts an embodiment of a positionable screen for a convertible water park.

In some embodiments, screens may be mounted to a fixed skeletal structure. The fixed skeletal structure may not move. The screens mounted to the fixed skeletal structure may be positionable along portions of the fixed skeletal structure. For example portions of a screen may be mounted on tracks positioned in the fixed skeletal structure. Tracks may allow the portions of the screens to be move up, down, and/or laterally. Positionable portions of screens mounted in a fixed skeletal structure may provide an alternative for opening/enclosing a portion of a waterpark to positionable screens as depicted in FIG. 11. In certain embodiments, the two concepts may be combined whereby portions of, for example, screen 30A are positionable within a skeletal structure of screen 30A.

Figure 12:
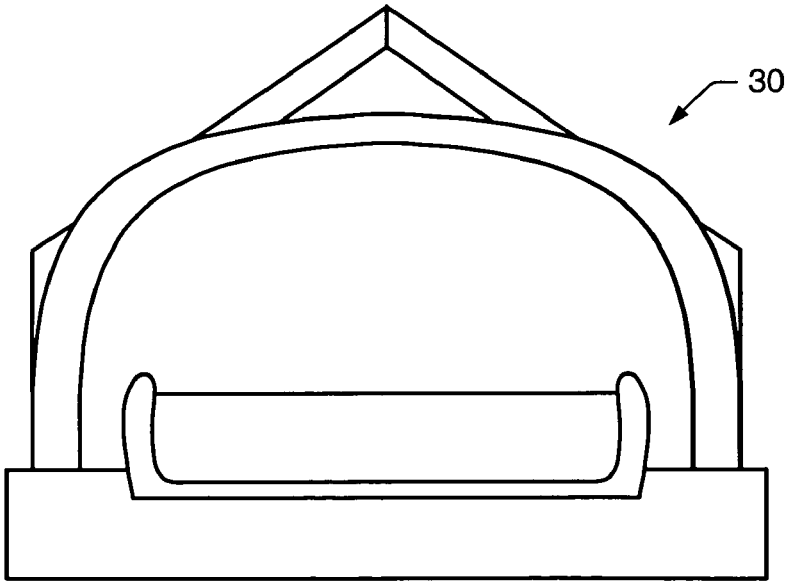
FIG. 12 depicts an embodiment of a positionable screen for a convertible water park.

FIG. 11 depicts an embodiment of a portion of a positionable screen system for use in a water amusement park. Screens 30A–C may be successively smaller. Making screens 30A–C successively smaller may allow the screens to be retracted within one another in a "stacked" configuration when not in use. During use (e.g., during inclement weather) screens 30A–C may be pulled out from under one another extending the screens over a portion of a waterpark (e.g., a river or channel) to protect participants from the elements. FIG. 12 depicts a cross-sectional view of an embodiment of a portion of a positionable screen system over a body of water. Screens 30A–C may include stops to ensure that when the screens are extended there is always a small overlap between the screens. Screens 30A–C may include seals to close the gaps between the screens when the screens are extended. In this way the portion of the waterpark is substantially enclosed within screens 30A–C. Screens 30A–C may be at least high enough to inhibit participants from colliding with the ceiling of the screens.

In a water amusement park embodiment depicted in FIG. 12, screens 30 have been extended over a portion of a channel or river. The channel connects different portions of a convertible water amusement park. In some embodiments, a channel (e.g., a river) including positionable screens may connect separate water amusement parks. Connecting separate water parks with screened channels may allow a participant to travel between waterparks without leaving the water even during inclement weather. Screens 30 allow for the use of the convertible water amusement park during inclement weather. Screens 30 may allow participants to travel between enclosed water park amusement area 32 and continuous water rides 2 as depicted in FIG. 3. Water park amusement area 32 may include food areas, games, water amusement games, water rides and/or any other popular forms of entertainment.

In some embodiments, screens form a convertible cover, i.e. in which panels forming the cover can slide relative to one another. Some sections, adapted for such structures, may include side grooves. Side grooves may facilitate positioning of the panels allowing the panels to slide relative to each other. In some embodiments, the convertible covers or screens may include curved arches forming the overall structure.

In some embodiments, sections of the framework forming a convertible cover or positionable screen may include frameworks known to one skilled in the art as relates to covers for swimming poois and/or greenhouses. For example, the framework may include substantially tubular metal frames. Portions of the tubular metal frames may include interior reinforcement members. Interior reinforcement members may strengthen the tubular metal frames. Interior reinforcement members may include hollow rectangular section positioned in the tubular metal frames.

In some embodiments, sections of the framework forming the positionable screens may be formed in the overall shape of an arch. Section may include one or more tracks positoined on one or more sides of the framework. The tracks may allow panels (i.e., portions of a screen) to slide along the sections of the framework relative to one another.

In some embodiments, screens may have several rigid frame members. The number may depend upon the length of the area being covered. Each frame member may include a plurality of sections which are connected together in end-to-end relationship. Sections may be any shape (e.g., rectangular, square, triangular). The connection between frame member sections may be by means known to one skilled in the art (e.g., bolts, hinges). Hinges may allow at least a portion of the structure to be folded if it is desired to remove the screen completely. Each of the rigid frame members may include a pair of oppositely disposed substantially vertical wall sections and ceiling sections jointed together in an arch. Between the rigid frame members are panels of flexible material which may be a canvas or other easily foldable material. End panels may also be formed of a foldable material which is preferably transparent or translucent.

In certain embodiments, a ceiling section may include a pair of parallel, longitudinally extending, channel-shaped side elements and a pair of channel-shaped end elements. The side flanges of each of the four elements forming the section extend inwardly. The side and end elements may be welded together or they may be held together by means of suitable fasteners to form a rectangular frame section. Attached to the outer (upper) side flanges of the elements are spacers which extend around the periphery of the structure. Outwardly of the spacers and coextensive with the side elements are a pair of upwardly extending smaller channel elements which are of greater width than the spacer and thus protrude inwardly over and are spaced from the top web of the larger side elements. This spacing will accomodate a rigid panel of transparent or translucent material such as plexiglass. Around the panel may be a resilient bead of flexible material which serves as a weather seal for the panel. Bolts may be used to connect the end element of frame section to the opposite end element of the next adjacent frame section. If desired, braces may be bolted to the sides of the frame member sections for added rigidity and strength at the joint.

In some embodiments, extending along the sides of the body of water may be a pair of spaced, parallel, channel-shaped track members. The track members may be identical in construction. The track member may have a base, sides, and top flanges. Top flanges close a part of the channel-shaped track member leaving only the longitudinal slot-like opening visible from the top of the track. The tracks may extend well beyond one end of the body of water so that the screen may be stored at that end. For drainage as well as assembly purposes, it may be desirable that at least one end of the track be open. The track may be suitably anchored by conventional screw anchors or the like (not shown).

In some embodiments, attached to the lower ends of each of the frame member wall portions are guide means which extend into the interior of a respective one of the channel-shaped track members for engaging the interior of the track members. Guide means allow that the frame members may be guided along the track members toward and away from one another to selectively cover and uncover the body of water between the track members.

In certain embodiments, a wall panel of a screen as well as the entire rigid frame structure may be clamped in the desired position of adjustment with respect to the track.

In certain embodiments, there may be a laterally stabilizing roller for engaging the side walls of the channel track. This roller also serves as part of the guide means to guide the frame member along the track keeping it in longitudinal alignment.

In some embodiments, for purposes of stability and smooth rolling action there may be provided a horizontal roller and a vertical roller at each end of the wall panels of the screen. Thus each of the wall panels will have a pair of vertical rollers and a pair of horizontal rollers.

In some embodiments, each of the frame members may have a pair of spaced, parallel, transverse portions. The end elements and the panel maintain the spacing of the side elements and the rigidity of the frame members. The bottom element of the wall sections may flatly engage the top of the track over a substantial longitudinal distance. This provides a solid locked-in-place stability for the frame member and there is little tendency for the frame members to skew or otherwise become misaligned. The provision of the rollers at either end of the wall panel provide stability during movement of the frame member.

In some embodiments, the end element of frame members meet at obtuse angles. A wedge-like spacer may be placed between the end elements of the adjacent sections. The spacer may be tapered in accordance with the angle at which the two sections are to be joined. The spacer may be apertured or slotted to accommodate the bolts 60 which are used to connect the end elements together.

In some embodiments, the roller carriage acts as the clamp for clamping the frame members in position, however it is not essential that this carriage double as a clamp. The roller carriage may be fixed in place and it could carry not only the horizontal roller but also the vertical roller. Other locking means could be provided for clamping the base plate and the end element of the wall section in flat position against the top of the channel track.

In certain embodiments, only short particular sections covering the body of water or channel may be rigid. A series of short rigid sections as described herein may be coupled together by stretches of flexible material. The sections of flexible material may be much longer relative to the supporting short rigid sections. The flexible material may allow the screen to be collapsed at those points at the screens are repositioned and retracted. The flexible material may be translucent much like the panels making up the rigid sections of the screen.

In some embodiments, some water amusement park areas may include immovable screens substantially enclosing the water amusement area (e.g., a dome structure). While other water amusement areas may remain uncovered year round. Channels may connect different water amusement areas. Channels may include portions of a natural river. Channels may include portions of man-made rivers or reservoirs. Channels may include portions of a natural or man-made body of water (e.g., a lake). The portions of the natural or man-made body of water may include artificial or natural barriers to form a portion of the channel in the body of water. Channels may include positionable screens as described herein. In some embodiments, an entire waterpark may include permanent and/or positionable screens covering the waterpark. In some embodiments, only portions of a waterpark may include permanent and/or positionable screens.

There are advantages to covering the channels and/or portions of the park connected by the channels as opposed to covering the entire park in, for example, one large dome. One advantage may be financial, wherein enclosing small portions and/or channels of a park is far easier from an engineering standpoint and subsequently much cheaper than building a large dome. Channels that extend for relatively long distances may be covered far more easily than a large dome structure extending over the same distance which covers the channel and much of the surrounding area. It is also far easier to retract portions of the screens described herein to selectively expose portions of a waterpark than it is to selectively retract portions of a dome.

In some embodiments, water amusement parks may include participant identifiers. Participant identifiers may be used to locate and/or identify one or more participants at least inside the confines of the water amusement park. Participant identifiers may assist control systems in the water amusement park. Participant identifiers may be considered as one portion of a water amusement park control system in some embodiments. Participant identifiers may be used for a variety of functions in the water amusement park.

In some embodiments, a plurality of personal identifiers may be used in combination with a water amusement park. Personal identifiers may be provided to each individual participant of the water amusement park. Personal identifiers may be provided for each member of staff working at the water amusement park. Within the context of this application the term "participant" may include anyone located in the confines of the water amusement park including, but not limited to, staff andior patrons. A plurality of sensors may be used in combination with the personal identifiers. Personal identifiers may function as personal transmitters. Sensors may function as receiver units. Sensors may be positioned throughout the water amusement park. Sensors may be positioned, for example, at particular junctions (i.e., coupling points) along, for example, a continuous water ride. Sensors may be placed along, for example, floating queue lines, channels, entry/exit points along water rides, and/or entry/exit points between portions of the water amusement park. Personal identifiers working in combination with sensors may be used to locate and/or identify participants.

In some embodiments, personal identifiers and/or sensors may be adapted for ultrasonic, or alternatively, for radio frequency transmission. Personal identifiers and/or sensors may operate on the same frequency. Identification of individual personal identifiers may be achieved by a pulse timing technique whereby discrete time slots are assigned for pulsing by individual units on a recurring basis. Pulses received from sensors may be transmitted to decoder logic which identifies the locations of the various transmitter units in accordance with the time interval in which pulses are received from various sensors throughout the water amusement park. A status board or other display device may display the location and/or identity of the participant in the water amusement park. Status of a participant may be displayed in a number of ways. Status of a participant may be displayed as some type of icon on a multi-dimensional map. Status of a participant may be displayed as part of a chart displaying throughput for a portion of the water amusement park.

In some embodiments, programming means may be provided for a participant identifier. Participant identifiers may be substantially identical in construction and electronic adjustment. Participant identifiers may be programmed to predetermined pulse timing slots by the programming means. Any participant may use any participant identifier. The particular pulse timing slot may be identified as corresponding with a particular participant using a programmer. Participant identifiers may be associated with a particular participant by positioning the participant identifier in a receptacle. The receptacle may be coupled to the programmer. Receptacles may function to recharge a power source powering the participant identifier. In some embodiments, a receptacle may not be necessary and the personal identifier may be associated in the water amusement park with a particular participant via wireless communication between the personal identifier and a programmer.

In some embodiments, participant identifiers may be removably coupled to a participant. The participant identifier may include a band which may be coupled around an appendage of a participant. The band may be attached around, for example, an arm and/or leg of a participant. In some embodiments, identifiers may include any shape. Identifiers may be worn around the neck of a participant much like a medallion. In some embodiments, an identifier may be substantially attached directly to the skin of a participant using an appropriate adhesive. In some embodiments, an identifier may be coupled to an article of clothing worn by a participant. The identifier may be coupled to the article of clothing using, for example, a "safety pin", a plastic clip, a spring clip, and/or a magnetic based clip. In some embodiments, identifiers may be essentially "locked" after coupling the identifier to a participant. A lock may inhibit the identifier from being removed from the participant by anyone other than a staff member except under emergency circumstances. Locking the identifier to the participant may inhibit loss of identifiers during normal use of identifiers. In some embodiments, a participant identifier may be designed to detach form a participant under certain conditions. Conditions may include, for example, when abnormal forces are exerted on the participant identifier. Abnormal forces may result from the participant identifier becoming caught on a protrusion, which could potentially endanger the participant.

In some embodiments, circuitry and/or a power source may be positioned substantially in the personal identifiers. Positioning any delicate electronics in the personal identifier, such that material forming the personal identifier substantially envelopes the electronics, may protect sensitive portions of the personal identifier from water and/or corrosive chemicals typically associated with a water amusement park. Participant identifiers may be formed from any appropriate material. Appropriate materials may include materials that are resistant to water and corrosive chemicals typically associated with a water amusement park. Participant identifiers may be at least partially formed from materials which are not typically thought of as resistant to water and/or chemicals, however, in some embodiments materials such as these may be treated with anticorrosive coatings. In certain embodiments, participant identifiers may be formed at least partially from polymers.

In some embodiments, a personal identifier may be brightly colored. Bright colors may allow the identifier to be more readily identified and/or spotted. For example, if the identifier becomes decoupled from a participant the identifier may be more easily spotted if the identifier is several feet or more under water. In some embodiments, a personal identifier may include a fluorescent dye. The dye may be embedded in a portion of the personal identifier. The dye may further assist in spotting a lost personal identifier under water and/or under low light level conditions (e.g., in a covered water slide).

Figure 13:
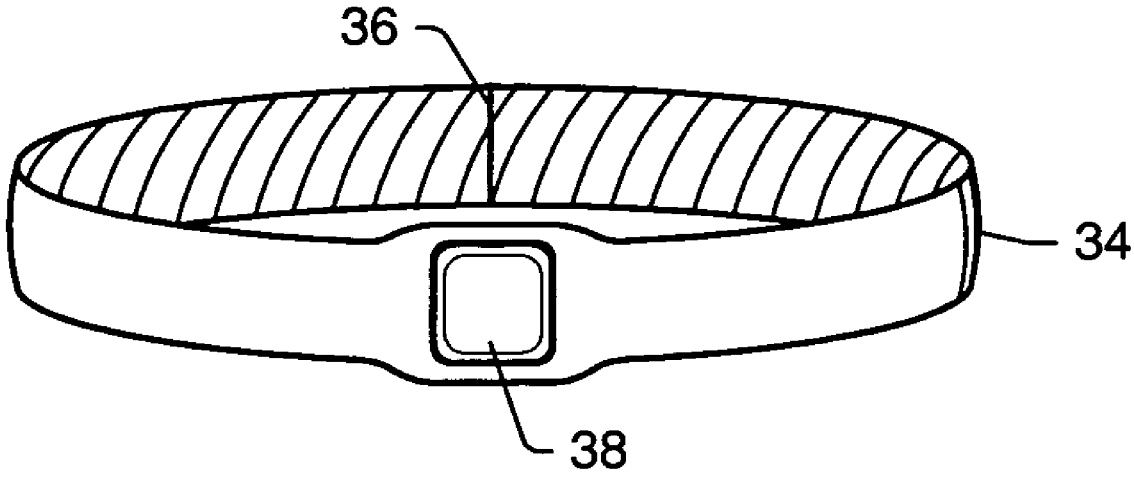
FIG. 13 depicts an embodiment of a participant identifier.

FIG. 13 depicts an embodiment of a participant identifier. Participant identifier 34 may be a wrist band as depicted in FIG. 13. Participant identifier 34 may include locking mechanism 36. Locking mechanism 36 may be positioned internally in participant identifier 34 as depicted in FIG. 13. Locking mechanism 36 may function so that only waterpark operators can remove participant identifier 34. This may reduce the chance of participant identifier 34 being lost. Participant identifier 34 may include interactive point 38. Interactive point 38 may be a display screen, a touch screen, and/or a button. Interactive point 38 may allow a participant to send a signal with participant identifier 34 so as to activate and/or interact with a portion of an amusement park (e.g., an interactive game). Interactive point 38 may display relevant data to the participant (e.g., time until closing of the park, amount of electronic money stored on the wrist band, and/or participant location in the waterpark).

Other components which may be incorporated into a participant identifier system are disclosed in the following U.S. patents, herein incorporated by reference: a personal locator and display system as disclosed in U.S. Pat. No. 4,225,953; a personal locator system for determining the location of a locator unit as disclosed in U.S. Pat. No. 6,362,778; a low power child locator system as disclosed in U.S. Pat. No. 6,075,442; a radio frequency identification device as disclosed in U.S. Pat. No. 6,265,977; and a remote monitoring system as disclosed in U.S. Pat. No. 6,553,336.

In some embodiments, participant identifiers may be used as part of an automated safety control system. Participant identifiers may be used to assist in determining and/or assessing whether a participant has been separated from their vehicle. Sensors may be positioned along portions of a water amusement park. For example sensors may be placed at different intervals along a water amusement ride. Intervals at which sensors are placed may be regular or irregular. Placement of sensors may be based on possible risks associated with a portion of a water amusement ride. For example, sensors may be placed with more frequency along faster moving portions of a water amusement ride where the danger for a participant to be separated from their vehicle is more prevalent.

In some embodiments, vehicle identifiers may be used to identify a vehicle in a water amusement park. The vehicle identifier may be used to identify the location of the vehicle. The vehicle identifier may be used to identify the type of vehicle. For example, the vehicle identifier may be used to identify how many people may safely ride in the vehicle.

In some embodiments, sensors near an entry point of a portion of a water amusement ride may automatically assess a number of participant identifiers/participants associated with a particular vehicle. Data such as this may be used to assess whether a participant has been separated from their vehicle in another portion of the water amusement ride.

In some embodiments, an operator may manually input data into a control system. Data input may include associating particular participant identifier(s) and/or the number of participants with a vehicle.

In some embodiments, a combination of automated and manual operations of a safety control system may be used to initially assess a number of participants associated with a vehicle. For example, an operator may provide input to initiate a sensor or a series of sensors to assess the number of participants associated with the vehicle. The assessment may be conducted at an entry point of a water amusement ride.

In certain embodiments, personal identifiers may be used in combination with a recording device. The recording device may be positioned in a water amusement park. One or more recording devices may be used throughout the water amusement park. The participant identifier may be used to activate the recording device. The participant identifier may be used to remotely activate the recording device. The recording device may include a sensor as described herein. The identifier may automatically activate the recording device upon detection by the sensor coupled to the recording device. The participant may activate the recording device by activating the personal identifier using participant input (e.g., a mechanical button, a touch screen). The participant identifier may activate one or more recording devices at one or more different times and/or timing sequences. For example several recording devices may be positioned along a length of a downhill slide. A participant wearing a personal identifier may activate (automatically or upon activation with user input) a first recording device positioned adjacent an entry point of the slide. Activating the first recording device may then activate one or more additional recording devices located along the length of the downhill water slide. Recording devices may be activated in a particular sequence so as to record the participant progress through the water slide.

In some embodiments, a recording device may record images and/or sound. The recording device may record other data associated with recorded images and/or sound. Other data may include time, date, and/or information associated with a participant wearing a participant identifier. The recording device may record still images and/or moving (i.e., short movie clips). Examples of recording devices include, but are not limited to, cameras and video recorders.

In some embodiments, a recording device may be based on digital technology. The recording device may record digital images and/or sound. Digital recording may facilitate storage of recorded events, allowing recorded events to be stored on magnetic media (e.g., hard drives, floppy disks, etc . . . ). Digital recordings may be easier to transfer as well. Digital recordings may be transferred electronically from the recording device to a control system and/or processing device. Digital recordings may be transferred to the control system via a hard-wired connection and/or a wireless connection.

Upon recording an event, the recording device may transfer the digital recording to the control system. The participant may purchase a copy of the recording as a souvenir. The participant may purchase a copy while still in a water amusement park, upon exiting the water amusement park, and/or at a later date. The control system may print a hard copy of the digital recording. The control system may transfer an electronic copy of the recorded event to some other type of media that may be purchased by the participant to take home with them. The control system may be connected to the Internet. Connecting the control system to the Internet may allow a participant to purchase a recorded event through the Internet at a later time. A participant may be able to download the recorded event at home upon arranging for payment.

In some embodiments, personal identifiers may be used in combination with sensors to locate a position of a participant in a water amusement park. Sensors may be positioned throughout the water park. The sensors may be connected to a control system. Locations of sensors throughout the water park may be programmed into the control system. The participant identifier may activate one of the sensors automatically when it comes within a certain proximity of the sensor. The sensor may transfer data concerning the participant (e.g., time, location, and/or identity) to the control system.

In some embodiments, participant identifiers may be used to assist a participant to locate a second participant. For example, identifiers may assist a parent or guardian to locate a lost child. The participant may consult an information kiosk or automated interactive information display. The interactive display may allow the participant to enter a code, name, and/or other predetermined designation for the second participant. The interactive display may then display the location of the second participant to the participant. The location of the second participant may be displayed, for example, as an icon on a map of the park. Security measures may be taken to ensure only authorized personnel are allowed access to the location of participants. For example, only authorized personnel (e.g., water park staff) may be allowed access to interactive displays and/or any system allowing access to identity and/or location data for a participant. Interactive displays may only allow participants from a predetermined group access to participant data from their own group.

In some embodiments, participant identifiers may be used to assist in regulating throughput of participants through portions of a water amusement park. Participant identifiers may be used in combination with sensors to track a number of participants through a portion of the water amusement park. Keeping track of numbers of participants throughout the water park may allow adjustments to be made to portions of the water park. Adjustments made to portions of the water park may allow the portions to run more efficiently. Adjustments may be at least partially automated and carried out by a central control system. Increasing efficiency in portions of the water park may decrease waiting times for rides.

In some embodiments, sensors may be positioned along one or both sides of a floating queue line. Sensors in floating queue lines may be able to assist in detecting participants wearing participant identifiers. Data concerning participants in the floating queue lines may be transferred to a control system. Data may include number of participants, identity of the participants, and/or speed of the participants through the floating queue lines. Based on data collected from the sensors, a control system may try to impede or accelerate the speed and/or throughput of participants through the floating queue line as described herein. Adjustment of the throughput of participants through the floating queue lines may be fully or partially automated. As numbers of participants in a particular ride increase throughput may decrease. In response to data from sensors the control system may increase the flow rate of participants to compensate. The control system may automatically notify water park staff if the control system is not able to compensate for increased flow rate of participants.

Figure 8:
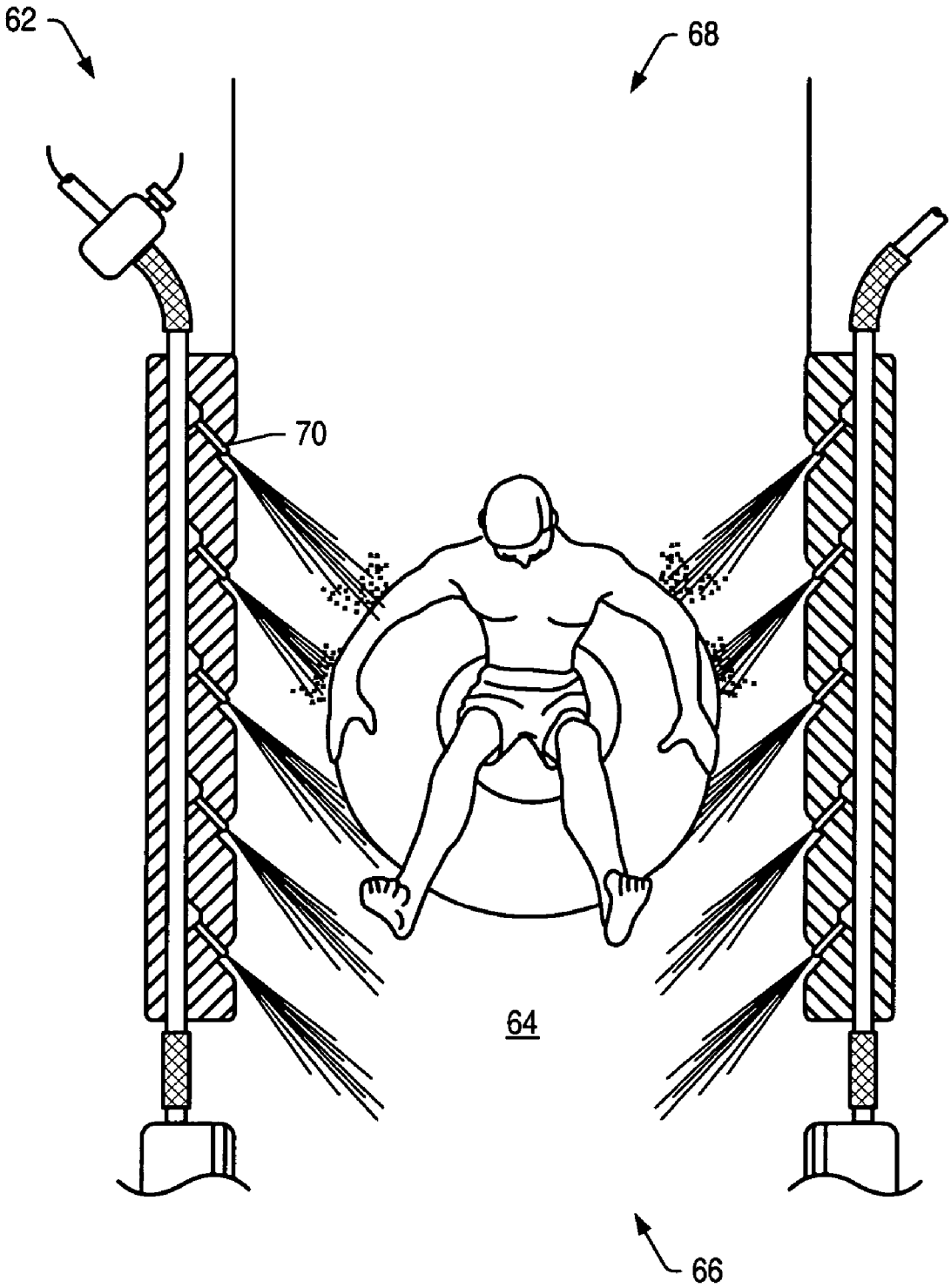
FIG. 8 depicts an embodiment of a floating queue line with jets.

In certain embodiments (an example of which is depicted in FIG. 8), floating queue system 62 includes a queue channel 64 coupled to a water ride at a discharge end 66 and coupled to a transportation channel on the input end 68. The channel 64 contains enough water to allow riders to float in the channel 64. The channel 64 additionally comprises high velocity low volume jets 70 located along the length of the channel 64. The jets are coupled to a source of pressurized water (not shown). Riders enter the input end 68 of the queue channel 64 from the coupled transportation channel, and the jets 70 are operated intermittently to propel the rider along the channel at a desired rate to the discharge end 66. This rate may be chosen to match the minimum safe entry interval into the ride, or to prevent buildup of riders in the queue channel 64. The riders are then transferred from the queue channel 64 to the water ride, either by a sheet flow lift station (as described previously) or by a conveyor system (also described previously) without the need for the riders to leave the water and/or walk to the ride. Alternatively, propulsion of the riders along the channel 64 may be by the same method as with horizontal hydraulic head channels; that is, by introducing water into the input end 68 of the channel 64 and removing water from the discharge end 66 of the channel 64 to create a hydraulic gradient in the channel 64 that the riders float down. In this case, the introduction and removal of water from the channel 64 may also be intermittent, depending on the desired rider speed.

In some embodiments, participant identifiers may be used with interactive games. Interactive games may include interactive water games. Interactive games may be positioned anywhere in a water amusement park. Interactive games may be positioned along a floating queue line, an elevation system, and/or a water ride. Interactive games positioned along portions of the water amusement park where delays are expected may make waiting more tolerable or even pleasurable for participants.

An interactive water game including a control system as described above may include a water effect generator; and a water target coupled to the control system. In some embodiments, the water effect generator may include a water cannon, a nozzle, and/or a tipping bucket feature. The water effect generator may be coupled to a play structure. During use a participant may direct the water effect generator toward the water target to strike the water target with water. A participant may direct the water effect using a participant identifier to activate the water effect generator. Upon being hit with water, the water target may send an activation signal to the control system. Upon receiving an activation signal from the water target, the control system may send one or more control signals to initiate or cease predetermined processes.

The water target may include a water retention area, and an associated liquid sensor. In some embodiments, the liquid sensor may be a capacitive liquid sensor. The water target may further include a target area and one or more drains. The water target may be coupled to a play structure.

In some embodiments, the interactive water game may include one or more additional water effect generators coupled to the control system. Upon receiving an activation signal from the water target, the control system may send one or more control signals to the additional water effect generator. The additional water effect generator may be configured to create one or more water effects upon receiving the one or more control signals from the control system. For example, the one or more water effects created by the additional water effect generator may be directed toward a participant. The additional water effect generator may include, but is not limited to: a tipping bucket feature, a water cannon, and/or a nozzle. The additional water effect generator may be coupled to a play structure.

A method of operating an interactive water game may include applying a participant signal to an activation point associated with a water system. The participant signal may be fully automated and originate from a participant identifier. The participant signal may be activated when a participant wearing the participant identifier positions themselves in predetermined proximity of the activation point. Participant input may activate the participant signal using the participant identifier. An activation signal may be produced in response to the applied participant signal. The activation signal may be sent to a control system. A water system control signal may be produced in the control system in response to the received activation signal. The water system control signal may be sent from the control system to the water system. The water system may include a water effect generator. The water effect generator may produce a water effect in response to the water system control signal. The water effect generator may be directed toward a water target to strike the water target with water. An activation signal may be produced in the water target, if the water target is hit with water. The water target may send the activation signal to the control system. A control signal may be produced in the control system in response to the received water target activation signal. In some embodiments, the interactive water game may include an additional water effect generator. The control system may direct a control signal to the additional water effect generator if the water target is struck by water. The additional water effect generator may include, but is not limited to: a water cannon, a nozzle, or a tipping bucket feature. The additional water effect generator may produce a water effect in response to a received control signal. The water effect may be directed toward a participant.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A water amusement system, comprising:

a first water amusement ride;

a second water amusement ride;

an elevation increasing system configured to convey at least one flexible inflated vehicle from an exit point of the first water amusement ride, or a point subsequent to such exit point, to an entry point of the second water amusement ride, or a point preceding such entry point, wherein the exit point of the first ride and the entry point of the second ride are at different elevation levels; and a second elevation increasing system configured to convey at least one flexible inflated vehicle from the exit point of the second or any subsequent water amusement ride, or a point subsequent to such exit point, to the entry point of the first water amusement ride, or a point preceding such entry point.

2. The system of claim 1, wherein the first water ride and/or the second water ride comprises at least one water releasing mechanism configured to inject water onto a surface of the water ride such that a body of flowing water is produced on the surface of the water ride.

3. The system of claim 1, wherein the elevation increasing system and/or the second elevation increasing system comprises a spiral transport device.

4. The system of claim 1, wherein an exit point of the second water amusement ride and an entry point of the first water amusement ride are coupled.

5. The system of claim 1, further comprising a third water amusement ride, wherein an exit point of the third ride is coupled to the exit of the second water ride, and wherein an entry point of the third or any subsequent ride is coupled to the entry point of the first ride.

6. The system of claim 5, wherein the exit point of the third or any subsequent ride is coupled to the exit of the second water ride with a body of water, and wherein an entry point of the third ride is coupled to the entry point of the first ride with a body of water.

7. The system of claim 1, further comprising a floating queue line coupled to an entry point of at least one of the water amusement rides.

8. The system of claim 7, wherein the floating queue line comprises a queue line channel wherein the queue line channel is configured to hold water at a depth sufficient to allow a flexible inflated vehicle to float within the queue line channel during use, and wherein the floating queue line is coupled to the water ride such that a flexible inflated vehicle remains in the water while being transferred from the channel along the floating queue line to the water ride.

9. The system of claim 1, wherein the elevation increasing system and/or the second elevation increasing system comprises a water slide, and wherein at least a portion of the water slide is uphill.

10. The system of claim 1, wherein the elevation increasing system or the second elevation increasing system comprises an uphill water slide.

11. The system of claim 1, wherein the elevation increasing system or the second elevation increasing system comprises a conveyor belt system.

12. A water amusement system, comprising:

a first water amusement ride;

a second water amusement ride;

an elevation increasing system configured to convey a flexible inflated vehicle from an exit point of the first water amusement ride to an entry point of the second water amusement ride, wherein the exit point of the first ride and the entry point of the second ride are at different elevation levels;

wherein the exit point of the second water amusement ride and the entry point of the first water amusement ride are coupled; and a third water amusement ride, wherein an exit point of the third ride is coupled to the exit of the second water ride, and wherein an entry point of the third ride is coupled to the entry point of the first ride.

13. The system of claim 12, wherein the first water ride, the second water ride, and/or the third water ride comprises at least one water releasing mechanism configured to inject water onto a surface of the water ride such that a body of flowing water is produced on the surface of the water ride.

14. The system of claim 12, wherein the elevation increasing system comprises a spiral transport device.

15. The system of claim 12, further comprising a second elevation increasing system configured to convey at least one flexible inflated vehicle from the exit point of the second water amusement ride to the entry point of the first water amusement ride.

16. The system of claim 12, wherein the exit point of the third ride is coupled to the exit of the second water ride with a body of water, and wherein an entry point of the third ride is coupled to the entry point of the first ride with a body of water.

17. The system of claim 12, further comprising a floating queue line coupled to an entry point of at least one of the water amusement rides.

18. The system of claim 17, wherein the floating queue line comprises a queue line channel wherein the queue line channel is configured to hold water at a depth sufficient to allow a flexible inflated vehicle to float within the queue line channel during use, and wherein the floating queue line is coupled to the water ride such that a flexible inflated vehicle remains in the water while being transferred from the channel along the floating queue line to the water ride.

19. The system of claim 12, wherein the elevation increasing system comprises a water slide, and wherein at least a portion of the water slide is uphill.

20. The system of claim 12, wherein the elevation increasing system comprises an uphill water slide.

21. The system of claim 12, wherein the elevation increasing system comprises a conveyor belt system.

22. A water amusement system, comprising:

a first water amusement ride;

a second water amusement ride;

a first elevation increasing system comprising a first end at a lower elevation coupled to an exit point of the first water amusement ride and a second end at a higher elevation coupled to an entry point of the second water amusement ride, wherein the first elevation increasing system is configured to convey at least one flexible inflated vehicle and/or participant from the first end to the second end of the first elevation increasing system; and a second elevation increasing system comprising a first end at a lower elevation coupled to an exit point of the second water amusement or any subsequent water amusement ride coupled to the second water amusement ride and a second end at a higher elevation coupled to an entry point of the first water amusement ride, wherein the second elevation increasing system is configured to convey at least one flexible inflated vehicle and/or participant from the first end to the second end of the second elevation increasing system.

23. A water amusement system, comprising:

a first water amusement ride;

a second water amusement ride;

an elevation system configured to convey at least one flexible inflated vehicle from an exit point of the first water amusement ride, or a point subsequent to such exit point, to an entry point of the second water amusement ride, wherein the exit point of the first ride and the entry point of the second ride are at different elevation levels;

a second elevation system configured to convey at least one flexible inflated vehicle from the exit point of the second or any subsequent water amusement ride to the entry point of the first water amusement ride; and a third water amusement ride, wherein an exit point of the third ride is coupled to the exit of the second water ride, and wherein an entry point of the third or any subsequent ride is coupled to the entry point of the first ride.

24. A water amusement system, comprising:

a first water amusement ride;

a second water amusement ride;

an elevation system configured to convey at least one flexible inflated vehicle from an exit point of the first water amusement ride, or a point subsequent to such exit point, to an entry point of the second water amusement ride, wherein the exit point of the first ride and the entry point of the second ride are at different elevation levels;

a second elevation system configured to convey at least one flexible inflated vehicle from the exit point of the second or any subsequent water amusement ride to the entry point of the first water amusement ride; and wherein the exit point of the third or any subsequent ride is coupled to the exit of the second water ride with a body of water, and wherein an entry point of the third ride is coupled to the entry point of the first ride with a body of water.

25. A water amusement system, comprising:

a first water amusement ride;

a second water amusement ride;

an elevation system configured to convey a flexible inflated vehicle from an exit point of the first water amusement ride to an entry point of the second water amusement ride, wherein the exit point of the first ride and the entry point of the second ride are at different elevation levels;

wherein the exit point of the second water amusement ride and the entry point of the first water amusement ride are coupled;

a third water amusement ride, wherein an exit point of the third ride is coupled to the exit of the second water ride, and wherein an entry point of the third ride is coupled to the entry point of the first ride; and a second elevation system configured to convey at least one flexible inflated vehicle from the exit point of the second water amusement ride to the entry point of the first water amusement ride.

26. A water amusement system, comprising:

a first water amusement ride;

a second water amusement ride;

an elevation system configured to convey a flexible inflated vehicle from an exit point of the first water amusement ride to an entry point of the second water amusement ride, wherein the exit point of the first ride and the entry point of the second ride are at different elevation levels;

wherein the exit point of the second water amusement ride and the entry point of the first water amusement ride are coupled; and a third water amusement ride, wherein an exit point of the third ride is coupled to the exit of the second water ride, and wherein an entry point of the third ride is coupled to the entry point of the first ride;

wherein the exit point of the third ride is coupled to the exit of the second water ride with a body of water, and wherein an entry point of the third ride is coupled to the entry point of the first ride with a body of water.

* * * * *